US007516690B2

(12) United States Patent
McClellan

(10) Patent No.: US 7,516,690 B2
(45) Date of Patent: Apr. 14, 2009

(54) FIREARM SUPPRESSOR, MOUNTING SYSTEM AND MOUNTING METHOD

(76) Inventor: W. Thomas McClellan, 2680 Arbor Dr., Fort Lauderdale, FL (US) 33312

( * ) Notice: Subject to any disclaimer, the term of this patent is extended or adjusted under 35 U.S.C. 154(b) by 0 days.

(21) Appl. No.: 11/644,531

(22) Filed: Dec. 22, 2006

(65) Prior Publication Data

US 2008/0148928 A1 Jun. 26, 2008

(51) Int. Cl.
*F41F 21/30* (2006.01)

(52) U.S. Cl. ..... 89/14.4; 89/14.2; 89/14.3; 181/223

(58) Field of Classification Search ..... 89/14.3, 89/14.4, 14.2; 181/223
See application file for complete search history.

(56) References Cited

U.S. PATENT DOCUMENTS

| | | | | |
|---|---|---|---|---|
| 1,773,443 | A * | 8/1930 | Wilman | 89/14.4 |
| 4,907,488 | A | 3/1990 | Seberger | |
| 4,974,489 | A | 12/1990 | Fishbaugh | |
| 5,029,512 | A | 7/1991 | Latka | |
| 5,078,043 | A | 1/1992 | Stephens | |
| 5,136,923 | A | 8/1992 | Walsh, Jr. | |
| 5,136,924 | A | 8/1992 | Förster et al. | |
| 5,679,916 | A | 10/1997 | Weichert | |
| 6,302,009 | B1 | 10/2001 | O'Quinn et al. | |
| 6,412,389 | B2 | 7/2002 | Fluhr | |
| 6,575,074 | B1 | 6/2003 | Gaddini | |
| 6,701,820 | B2 | 3/2004 | Fluhr | |
| 6,796,214 | B2 | 9/2004 | Hausken et al. | |
| 6,948,415 | B2 | 9/2005 | Matthews et al. | |

* cited by examiner

*Primary Examiner*—Stephen M Johnson
(74) *Attorney, Agent, or Firm*—Laurence A. Greenberg; Werner H. Stemer; Ralph E. Locher

(57) ABSTRACT

A firearm suppressor includes a housing to be mounted to a firearm. The housing defines a lumen therein for receiving gases from the firearm. At least one stripper member is disposed in the lumen for engaging and deflecting the gases. At least one one-way flow element is disposed downstream of the at least one stripper member in gas flow direction for permitting a one-way flow of the gases. At least one decompression chamber is disposed downstream of the at least one one-way flow element for reducing energy in the gases. At least one vent valve is disposed downstream of the at least one decompression chamber for expelling the gases into the atmosphere. A mounting system and a mounting method are also provided.

17 Claims, 51 Drawing Sheets

FIG.49
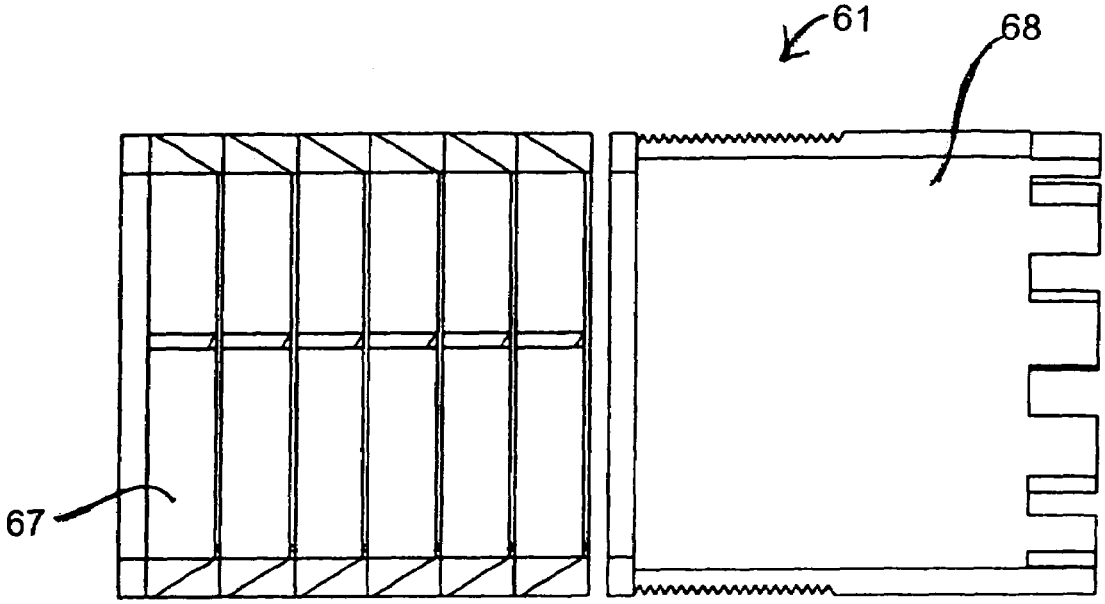
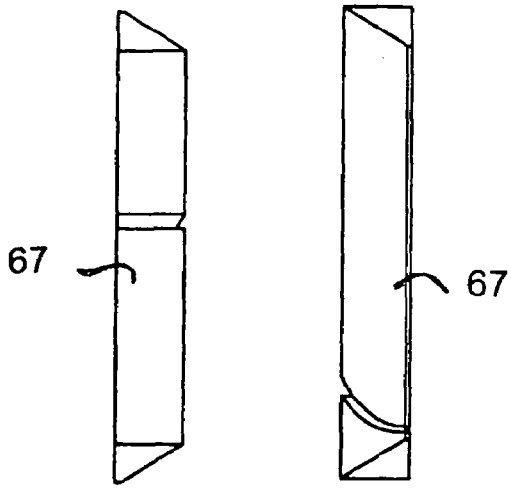
FIG.50

FIREARM SUPPRESSOR, MOUNTING SYSTEM AND MOUNTING METHOD

BACKGROUND OF THE INVENTION

1. Field of the Invention

The invention relates to an improved firearm suppressor. The invention also relates to a mounting system and a mounting method.

2. Description of the Related Art

Firearm suppressors are intended to reduce the nerve racking, shooter revealing, and ear damaging effects of muzzle sound, muzzle blast, visible muzzle flash and invisible infrared flash of firearms. The confusion and chaos of close-quarters combat is worsened by multidirectional unexpected muzzle blasts. The futile use of earplugs only restricts communication, reduces group unity and lessens awareness of the surroundings. The problem must be attacked at its source, which is the muzzle.

No suppressor can be effective unless it can first "contain the explosion" of the propellant gases. The prior art baffles form small, partially or non-vented, symmetrical, concave walled compartments which create perfect "reflection contours." The reflected waves return and even focus the pressure energy back into the lumen for instant escape from the muzzle. The minor turbulences created by those prior art baffles do little to effectively suppress any significant energy. They pressurize quickly and pass the remaining gases and energy straight through "unaltered."

SUMMARY OF THE INVENTION

It is accordingly an object of the invention to provide an improved firearm suppressor, a mounting system and a mounting method, which overcome the hereinafore-mentioned disadvantages of the heretofore-known devices and methods of this general type and which reduce the effects of muzzle sound, muzzle blast, visible muzzle flash and invisible infrared flash of firearms.

With the foregoing and other objects in view there is provided, in accordance with the invention, a firearm suppressor. The suppressor comprises a housing to be mounted to a firearm. The housing defines a lumen therein for receiving gases from the firearm. At least one stripper member is disposed in the lumen for engaging and deflecting the gases. At least one one-way flow element is disposed downstream of the at least one stripper member, in gas flow direction, for permitting a one-way flow of the gases. At least one decompression chamber is disposed downstream of the at least one one-way flow element for reducing energy in the gases. At least one vent is disposed downstream of the at least one decompression chamber for expelling the gases into the atmosphere.

In accordance with another feature of the invention, the at least one stripper member is a plurality of stripper cones being partially spaced apart from each other to define spacings therebetween for the gases.

In accordance with a further feature of the invention, the plurality of stripper cones each include a sharpened upstream edge for catching and deflecting a gas stream into the stripper cones, rounded downstream edges providing aerodynamic surfaces or airfoils for pulling additional gas into the stripper cones acting as a gas trap, and laterally curved spacing ridges maintaining the spacing and steering the gases in laterally curving arcs to decrease an angle of impact with a wall of the housing.

The suppressor according to the invention, has specific structural features for "containment" by deflection and entrapment of the propellant gases to prevent the pressure wave or excited gases from reaching the atmosphere to "create" or become sound. These new features deflect and steer the high-speed, still-expanding gases and pressure waves away from the outlet. A majority of the expanding gases are directed from the suppressor lumen by a system of "stripper cones." Prior art baffles "allow" some gas deflection while the cone system according to the invention "causes" gas deflection. The system of closely spaced, stacked cones is angled to engage and deflect the fast expanding gases in their forward and angular trajectory. These narrow slots form spreading or increasing volume spaces which help draw in the expanding hot gases. The lumen-facing cone surfaces have "sharpened (upstream) edges" to catch and deflect the gas stream into the cone system and "rounded (downstream) edges" acting as aerodynamic surfaces or airfoils to pull additional gas into the "cone trap."

The complete system of stripper cones is directly vented into the adjacent portion of the first decompression chamber. The gas flows between the cones, which also have laterally "curved" spacing ridges between each cone serving not only to maintain cone spacing, but also steer the gases in laterally curving arcs to decrease the angle of impact with the wall. The gases are vented laterally and refracted or further curved by the outside suppressor wall due to this low angle of incidence.

These "directed flow" and curved walls create a functionally asymmetrical chamber with no reflective surfaces or symmetrical wall harmonics. The gas flows along the walls toward the rear because of the declining pressure gradient into the larger main portion of the containment and first decompression chamber.

The structural features for deflection take advantage of the energy within the gases such as heat and pressure but mostly its kinetic energy or inertia of movement. Its own great velocity of motion and "tendency to remain in motion" is used as the force to cause its deflection and entrapment.

The deflection of the high-speed gases according to the invention is important for improved suppression.

In accordance with an added feature of the invention, at least one one-way flow element is a plurality of live hinge valves disposed in a collar covering the at least one stripper member.

In accordance with still a further feature of the invention, a support tube is disposed within the housing, and a middle support member is disposed between the support tube and the live hinge collar. The middle support member has an opening formed therein for the gases.

According to this new propellant gas entrapment system for firearm suppressors, after deflection, the gases must be entrapped to complete "containment." Surrounding the stripper cones is a plurality of live-hinge valves. The live-hinges lift easily as the deflected gases flow into the initial portion of the first decompression chamber and close instantly against the cones to prevent any return flow or escape as the pressures equalize.

The most powerful and clear energy in the propellant gases is the supersonic "pressure wave" of the ejectant, which creates the major part of the muzzle sound, blast, flash and infrared flash. This dominant form of the energies acts by direct impact as one immense pulse of "supersonic" gas pressure wave against the atmosphere which yields a broadband, short interval, very high amplitude sound, characteristically heard as the intense "crack".

The second or further hidden "noise creating energy" within the gases is the high pressure, heat turbulence and the increased molecular velocities "within and of" the gas molecules themselves. This second form of energy acts by vibrating the air with a series of smaller pulses. This "subsonic" complex has many frequencies and is heard as the longer but less intense "boom." Both energies are "potential sound" and prevention of their unaltered escape is important to suppression.

The higher-grade supersonic wave energy (pressure plus velocity) is deflected by the stripper cones and entrapped by the valves or "contained" in the chamber. This containment reduces the gases velocity and changes the energy to subsonic. At "containment" (deflection plus entrapment) both forms of energy are confined and combined into lower-grade energy (pressure and turbulence without velocity). This lower energy, (excited pressure) is now controllable by the other features of the suppressor, namely serial decompression, delayed dissipation and sound reduction features of the interior. All of these features work together in a sequence of stages to control the velocity, then pressure and embedded turbulences, then sound progression, to prevent or suppress sound.

The reduction of velocity by entrapment and containment is important for improved suppression.

In accordance with an additional feature of the invention, the at least one decompression chamber includes three decompression chambers having baffles disposed therebetween. The baffles have slits formed therein for conducting a flow of the gases between the decompression chambers.

With the new multichamber, multistage decompression system for firearm suppressors, a suppressor cannot change the "amount" of energy or pressure released by the propellant gases but can alter its ability to make sound with two or more serially connected correctly vented, decompression chambers. These are used to alter this extreme pressure through controlled step-down decompression to near atmospheric levels. Stepped decompression, recompression, decompression between multiple chambers is much more effective against the major pressure drops and high volumes faced by suppressors than any single chamber devices. To obtain an equivalent "rate of change" using only a single chamber would require a suppressor of unusable size.

Controlled decompression of extreme pressure differentials in multiple chambers by controlled venting is important to improved suppression.

In accordance with yet another feature of the invention, steel wool fills at least one of the decompression chambers.

In accordance with yet a further feature of the invention, two end caps are disposed at ends of the housing. At least one of the end caps has an inner surface with non-reflective facets or an anechoic coating, disposed thereon.

According to the new delayed dissipation of energy system for firearm suppressors, the energy dissipated, in either uncontrolled, high amplitude, short interval muzzle "blast" or in controlled, low amplitude, long interval muzzle "flow" is identical. Whether by explosion or by slow leak, or as stopping a car with a wall or by using brakes, all these situations dissipate the same amount of energy; only the "time intervals" differ. Prolonging the time interval of energy dissipation is the important key to efficient suppression.

The invention uses specific structural features to intentionally expand this time line to lower acoustic results. Expanding the time interval must begin by having containment or the "zero point" on the time line. Only then can the repetitious decompression from one chamber and recompression in the next chamber begin by controlled venting. Without containment, the escape begins before the peak of the pressure has even arrived. There is no "time line" of delay because there is no delay. Only after gases are "contained" can the second part or controlled delay by venting begin. Each venting is interspersed with time consuming reverse flow passageways, which are lined with either non-reflective faceted surfaces or anechoic coatings and filled with acoustic steel wool. These serially connected, asymmetric, decompression and passage chambers have sound restricting "slit vents" located at their opposite ends.

Sound (a circular pulsating pressure wave) passes through round holes leaving the pressure pulse relatively intact. Narrow slits easily pass pressure but delay and break up the symmetrical wave forms causing disorganization, scatter and phase shifting. The gases must travel back and forth through another obstacle the "pressure passing" but "sound suppressing" steel wool, which further breaks up the symmetry of sound and further prolongs the delay time.

The features according to the invention, which control and prolong or delay the dissipation time interval, are important for improved suppression.

Accordingly, in the new internal sound reduction system for firearm suppressors, in order to prevent or reduce internally produced or continued sounds, all of the internal surfaces are treated with one or more of the following sound reduction techniques: non-harmonically opposed surfaces, anti-reflective surface angles, non-focusing concave surfaces, non-symmetrical chambers, non-parallel surfaces, positively refractive surfaces and absorptive techniques such as faceted non-reflective surfaces and anechoic coatings.

The reduction of internally generated, internally transmitted or continued sound by refraction, phase shifting and absorption, is important to improved suppression.

With regard to the improved "subsonic bullet fire" suppression system for firearm suppressors, it is noted that some heavy subsonic bullets have a supersonic propellant wave front which exits with the bullet and mimics the classic supersonic muzzle "crack." Short-barrel, large-bore firearms with abundant fast-burn modern propellants are notorious for their unexpected and disproportional muzzle blast. Not only is the gas flow supersonic, but a clear surplus of burning gas continues well after the bullet has left the barrel.

This containment of this powerful supersonic wave and surplus gas according to the invention, is important to improved suppression.

Regarding the improved "supersonic bullet fire" suppression system for firearm suppressors, it is also noted that supersonic bullets emit two independent sonic "booms." The first is heard from the supersonic propellant wave front, which exits with the bullet and the second is heard all along the bullet's path caused by the shockwave of its speed. Supersonic bullet fire appears louder at the muzzle because at the instant of bullet exit "both of the sonic waves are superimposed" plus the hidden secondary noise of the gas turbulence is also present and added. Downrange, the bullet speed noise remains and cannot be suppressed at the muzzle, but moving away from the shooter the sound has less amplitude and even becomes Doppler shifted lower in frequency. Since the sonic wave travels downrange as an "enlarging donut," it is distorted and reflected upward by the terrain interference. The downrange observer has only indistinct awareness of direction or the shooter's position. The loudest sound and flash most revealing of the shooter's position comes from the muzzle. Downrange the muzzle flash is seen first, followed by the slight whiz of bullet passage, then the vague sonic boom of the bullet and lastly the distant muzzle blast. Only the muzzle flash and muzzle blast localize the shooters' position. Supersonic rounds have been considered non-suppressible, but the most significant negatives of propellant shockwave blast, secondary gas turbulence blast, visible muzzle flash and infrared flash, are all well suppressed by the "containment" suppressor according to the invention.

The containment, conversion and control of the supersonic components of the muzzle blast, muzzle sound, muzzle flash and infrared flash at the muzzle, are important for improved supersonic bullet fire suppression.

In accordance with yet an added feature of the invention, there is provided at least one vent valve for venting gases at excess pressure from the lumen. The at least one vent valve has a tube for the gases and a spring cooperating with the tube for absorbing pressure of the gases.

In accordance with still another feature of the invention, there is provided a support tube disposed within the housing, two end caps disposed at ends of the housing outside the support tube, tie rods interconnecting the end caps, and at least one vent valve disposed at one of the end caps for relieving excess pressure.

It is noted regarding the new automatic overpressure release system for firearm suppressors, that in a containment-type suppressor, the containment volume and decompression rate are limited. Effective decompression between each round fired requires approximately two and three seconds for a "select" rate of fire limit of 20 to 30 rounds per minute, while still retaining good suppression. Sustained or automatic fire overcomes the containment and decompression limits, so that automatic pressure relief vents are placed in the rear of the primary containment chamber to vent excess pressures. Sustained fire is well tolerated using the relief vents, but muzzle noise does increase because containment, decompression, delay and internal sound reduction features have been bypassed. At times when sustained fire is required, the need for suppression becomes less important.

These structural features according to the invention, which automatically adjust for and release excess pressures, are important to improved suppression of sustained or automatic fire.

A new easy serviceability structure for firearm suppressors is provided by avoiding welded or fused assemblies and using dividable parts and sub-assembles held by simple fasteners and unique part-into-part supporting members. This entire suppressor according to the invention, including mounts, is quickly removable and can be completely disassembled for easy service.

In accordance with yet an additional feature of the invention, a support tube is disposed within the housing, at least one torsion spring retainer unit is disposed on the support tube, and at least one barrel mount is disposed on the at least one retainer unit for mounting the suppressor on a barrel of the firearm.

In accordance with again another feature of the invention, the at least one torsion spring retainer unit includes two torsion spring retainer units, and the at least one barrel mount includes a front barrel mount to be screwed to a threaded button on the barrel and a rear barrel mount to be fused to the barrel.

In accordance with again a further feature of the invention, the retainer units have inwardly-projecting locking lugs for holding the retainer units to the support tube.

In accordance with again an added feature of the invention, the rear barrel mount has a mount body with pressurizing ports formed therein, split rings to be disposed within the mount body and a compression driver for expanding and contracting respective ones of the split rings between the mount body and the barrel.

In accordance with again an additional feature of the invention, end caps are disposed at ends of the housing, and the front barrel mount has a nut disposed at one of the end caps.

In accordance with still another feature of the invention, the front and rear suppressor mounts have in-ramps, out-ramps and receivers for the locking lugs of the retainer units, permitting the suppressor to be directly pushed on and pulled off by turning.

The new alignment integrity system for firearm suppressors maintains the barrel-to-suppressor alignment during combat or field use, which is important for shooter safety. If a bullet strikes a displaced suppressor structure, the "following round" is fired into an occluded passage with possible catastrophic results. Alignment integrity is also important to reducing the bullet-to-suppressor wall clearance, which is important to prevent "blow-by" and to improve efficiency. The integrity of the connection must tolerate normal active use and even abuse while still retaining perfect alignment.

Prior art "can" type suppressors with single point, one-ended mountings and a right angle joining between the "can" wall and the end plate, have such poor alignment integrity as to make their use in combat or even knock-about situations unsafe.

The invention maintains alignment integrity by an interlocking, part-into-part, triple through-bolted, "truss stiffened" structure including the end caps, which locks to the mounts with four axis security and extends over and integrates with the barrel. The suppressor and barrel become as one piece. The major portion of the suppressor structure encases over the barrel and is retained by a widely separated bolted-on front barrel mount and a pressured fused rear barrel mount. The attachment mounts integrate with the barrel and lock to the suppressor with engaging matched parts having four or more locking lugs.

A new quick attachment system for firearm suppressors is provided because a versatile weapon system requires a secure and quickly attachable and removable suppressor.

The prior art uses ineffective screw-on "can type" or non-easily removable integrated suppressors.

The invention not only provides more stability and efficacy than any prior suppressor, but also with a quick attachment and removal system. Two length-wise separated mounting collars strongly affixed to the firearm barrel mate with matching separated collars in the suppressor with four or more spring-driven locking lugs allowing quick self-locking, easy-releasing use. Both the forward and rear locking lug receivers have tapered linear "in ramps" which allow easy finding of the ramps and direct push-on attachment of the suppressor. These "in ramps" narrow at the rear and drop into deeper engagements or locking lug receivers. These deeper locking engagements have bottom matching laterally running "out ramps" for quarter-turn unlocking and pull-off detachment of the suppressor. This more effectively secured integrated suppressor can be mounted or dismounted from the firearm in less than two seconds.

Lugs, pins or balls are frequently used to secure or position one object or tube in or over another object or tube. By penetrating the one object and engaging the other object, the engaging lugs, pin or balls can mark, detent, limit or lock the two objects in relative position. This inter-engagement of objects can be loosely held as in ball bearings marking a detent with just spring pressure or by a stronger, more permanent fitment by constricting or expanding collars or locking mechanisms which hold the engaging devices firmly embedded into both objects.

In prior art systems which use spring retention of the locking or position holding lugs, pins or balls rely on large, complex, multipart systems to hold the springs. Those more permanent attachments of the spring mechanism use screws, bolts, rivets, welding or separate additional ring clip devices.

With the prior art round torsion, round coil or long flat tension-compression springs, the securing methods are not only complex and failure prone, but even worse they are large, which prevents small compact constructions or uses.

The spring attaching devices must hold or secure the spring in proper position longitudinally, vertically, laterally and rotationally.

The securing lugs, pins or balls also require separate containment devices to prevent their loss or outward escape from the working shaft or over-penetration and loss inwardly if the inner object is removed or the inverse, depending on their orientation.

In a new self-retaining torsion spring locking lug system according to the invention, the securing or locking mechanism is held by the retaining spring's own structure. The springs are not machine fastened to either object but are held in basic or initial plane position or placement by its matching fitment over, around or inside of one of the two objects. The new self-retaining, flat spiral or flat zigzagging torsion spring or springs are secured in all four planes or axes as in lengthwise; vertically, laterally and rotationally, by small end projections extending from the engaging lug, pin or ball, which penetrate matching holes or indentations in the retainer springs. The pins or lugs retain the spring and the spring retains the pins or lugs.

The new spiral, circular or zigzag construction according to the invention creates a torsion spring that can be used in a much more compact area than conventional long, spiral, coil or wound springs because of its own retention by part-into-part fitment rather than additional machining, attachments or devices. They have small foot prints or space requirements and have very limited vertical space requirements. They allow the point of spring effort to be placed much closer to the point of the spring's attachment, adding to its compactness.

The new flat, self-retaining torsion spring system according to the invention has a longer spring travel range and more consistent spring pressure throughout its range of motion. The improved system is easily and cost-effectively manufactured, installed, removed and maintained.

In the new self-retaining torsion spring locking lug system, the new locking lug retainer springs are not fastened to the main support tube, but are held in position by its matching diameter fitment over the support tube and secured lengthwise, laterally, and rotationally by small end projections extending from the locking lugs, which penetrate matching holes in the end of the retainer springs. This circular flat structure of a compact torsion spring according to the invention allows their use in much more compact areas than conventional prior art tension/compression, long coil or wound springs. They allow the point of spring effort to be placed closer to the point of the spring's support. They are simple nonattached, self-retaining retainer springs with lugs having shoulders to prevent over penetration and have a more compact vertical height than conventional coiled springs for use in confined spaces. The spring rate and length of a more constant spring effort zone are also enhanced by these new circular flat torsion springs as compared to prior art flat tension/compression or coiled wound springs. The springs retain the lugs and the lugs retain the springs.

According to the new bolt-on front barrel mount for firearm suppressors, the front suppressor mount is secured to the barrel's threaded shaft by a socket driven nut. The front suppressor mount has a forward taper for easy passage of the suppressor. The front mount contains two or more tapered entrance ramps for the locking lugs in the matching suppressor mount. Not only should the suppressor be easy to attach and detach from the weapon, but the mounts must also be field removable. An easily removed barrel end mount improves weapon versatility.

A removable barrel end mount, which exposes the bare end or threaded barrel button, is important for quick change use in multi-mission requirements. The barrel end mount is secured by a special end driven socket nut, which is simple to remove, leaving the threaded barrel end clear and ready for quickly mounting other devices.

Through the use of the new semi-permanent rear barrel mount for firearm suppressors, the rear barrel mount remains on the barrel and is securely locked in place. This rear suppressor mount is part of the widely spaced two mount system which locks the suppressor in all four axes with improved security. This rear mount is field installable and semi-permanently locked to the barrel with the security of a machined attachment. The three-piece rear mount is formed of the mount body, which slides over the barrel having a formed under-cut space for thin split rings of a softer more malleable metal or other suitable material. The third piece or threaded end cap slides over the barrel first and screws into the rear mount, retaining and expanding the overlapping split rings strongly engaging the mount to the barrel. In order to ensure increased security of attachment to the mount surface, multiple holes are formed in the wall of the rear mount giving enhanced grasp by softer material split rings under high pressure. This new mounting feature provides machined security against dislodgement without machining expense or permanently scarring the weapon and can be done in the field without skilled assistance.

In accordance with still a further feature of the invention, a fusing fixture is to be placed over the rear barrel mount. The fusing fixture has pressure bolts threaded therethrough for applying pressure to the rear barrel mount and fusing the rear barrel mount to the barrel. The fusing fixture is removed after fusing.

With the new high-pressure, flow-fusing or flow-bonding device, the rear mount is well secured by the previously described expansion of the softer pure aluminum or other suitable material split rings by the threaded internal collar compression.

In situations where ultimate strength is required in mounting the rear suppressor mount to the barrel or in other object-into-object permanent mountings, a process of high pressure flow-fusing or bonding is presented.

Ultimate strength and permanent mounting of these metal to metal objects is accomplished by use of the access holes in the walls of the object, in this case the rear mount (over the split rings) and a special high-pressure, flow-fusing fixture.

The softer metal or other suitable material rings are used to lock the mount or outer object to the barrel or inner object by using extremely high pressure to flow the compressed material into the microscopic irregularities of both the inner and outer objects. Known similar metals are commonly used to fuse, bond or solder metal objects together. The heat flowing is replaced in this case with pressure flowing by the use of extreme pressure through a pressure generating fixture.

Under heat or extreme pressure, metals become more liquid in nature and behave under the laws of hydraulics. By using an array of small bolts through the special fixture surrounding the rear mount or other object to be affixed and using the precut access holes over the split rings, the small bolts can be turned into the soft inner split rings generating a force sufficient to flow the ring material like heavy syrup. The forces, created by the small pistons are measured in the order of many tons per square inch, causing the now flowing material to fill the irregularities of the inner and outer surfaces, identical to soldering. This process works well with machine cut aluminum alloy barrels and other similar objects which cannot tolerate the damaging heat.

The resultant evenly distributed retaining pressure is not only less scarring and destructive to the barrel surface, but does not cause concentrated stress distortions in the barrel wall which alter the accuracy or aim point of the barrel, as do single or focused pressure point retaining devices.

The high-pressure, metal flow-fusing fixture is constructed to form fit over the "mount or other device" to be fixed in place. The high-pressure inducing fixture is constructed of hardened steel or other suitable material and is constructed to slide over or to be clamped over or around the suppressor mount or target item with great strength. The created space on the underside of the mount or device to be affixed conforms to the barrel or the target item but leaves a spacing for the soft metal fusing layer. A flowable but sufficiently strong metal, like pure aluminum, or other suitable material, is used to fill this cavity completely in the form of split rings or coils. Steel vertical end seals are used to contain the flowable material from escape.

Small diameter, fine thread, hardened bolts fitted through the fixture are turned in sequenced rotation to create an even and extreme pressure of many tons per square inch against the relatively soft flowable metal or other suitable material. The physical laws of hydraulics allow for extreme pressure to be placed on the larger surface by the small bolts in inverse proportion to their diameters. The smaller the bolt or "piston" diameter, the greater the pressure that can be forced against the larger surface area. The mechanical advantage created by the smaller, fine threaded bolts turned into the soft material is almost beyond measure.

The compressed metal or material becomes hot and flows like heavy syrup into the microscopic irregularities of the target items, in this case the barrel on one side and the underside of the mount on the other. Whether by using heat to flow metal or by using pressure to flow metal, the accomplished fusing, bonding or soldering of dissimilar metals is the same.

The pressure flowing fixture is removed after cooling and the fitted immoveable collar and mount are now pressure-bonded to the barrel with great security or as any other object piece can be attached to its target item. Parts can be attached with machined-on strength without the machining expense or exposing sensitive barrels or other objects to damaging heat.

The process and fixture allow metal-fused security inexpensively and portably in the field without special assistance, saving time and money.

Shoulders on the small diameter bolts limit their depth to prevent damage to the barrel or other objects. Variations of this process and fixture can be used to fuse by high pressure flow-fusing of many similar or dissimilar metals with great strength.

With the objects of the invention in view, there is also provided a mounting system. The system comprises a first object formed of a relatively hard material and a second object formed of a relatively soft material. The second object is disposed outside the first object at a distance, defining a cavity between the first and second objects. A fusing fixture is to be placed outside the second object for fusing the second object to the first object, and to be removed after fusing. Pressure bolts are threaded through the fusing fixture for applying pressure to the second object, causing the relatively soft material to flow and fill the cavity.

With the objects of the invention in view, there is additionally provided a mounting method. The method comprises providing a first object formed of a relatively hard material, placing a second object formed of a relatively soft material outside the first object at a distance defining a cavity between the first and second objects, and placing a fusing fixture outside the second object. Pressure is applied to the second object with pressure bolts threaded through the fusing fixture, causing the relatively soft material to flow and fill the cavity for fusing the second object to the first object. The fusing fixture is removed after fusing.

Of course, the position of the first and second objects could be reversed, with the fusing fixture operating from the inside.

In accordance with a concomitant feature or mode of the invention, the first object is a barrel of a firearm, and the second object is a suppressor mount.

Other features which are considered as characteristic for the invention are set forth in the appended claims.

Although the invention is illustrated and described herein as embodied in an improved firearm suppressor, a mounting system and a mounting method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 49 and 50 are side-elevational views of assembled and disassembled split rings.

DESCRIPTION OF THE PREFERRED EMBODIMENTS

Figure 1A:
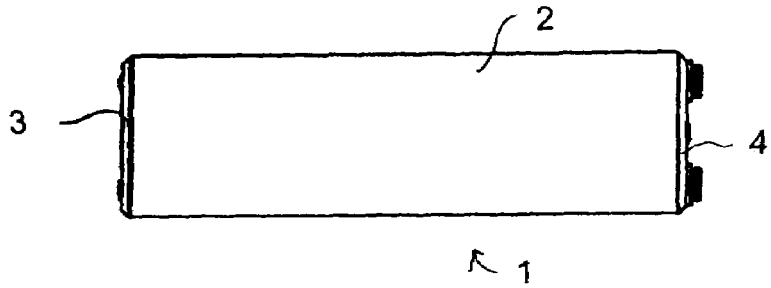
FIGS. 1A-1E are respective diagrammatic, top-plan, front-elevational, side-elevational, rear-elevational and perspective views of an improved firearm suppressor according to the invention in an assembled condition.
Figure 1B:
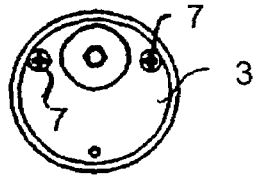
Figure 1C:
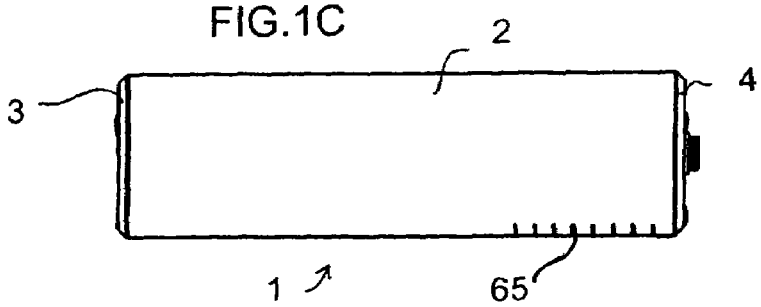
Figure 1D:
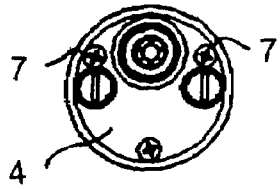
Figure 1E:
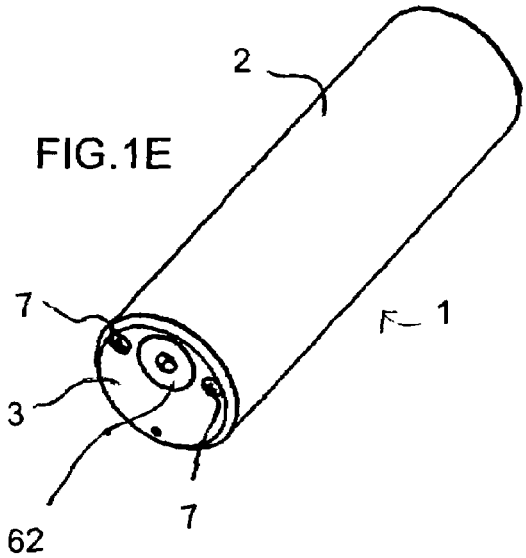
Figure 2B:
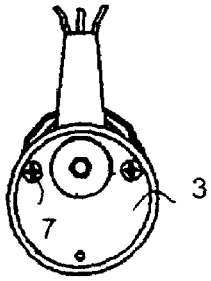
FIG. 2A-2C are respective fragmenatary, side-elevational, front-elevational and fragmentary, perspective views of the firearm suppressor in a mounted condition.
Figure 2A:
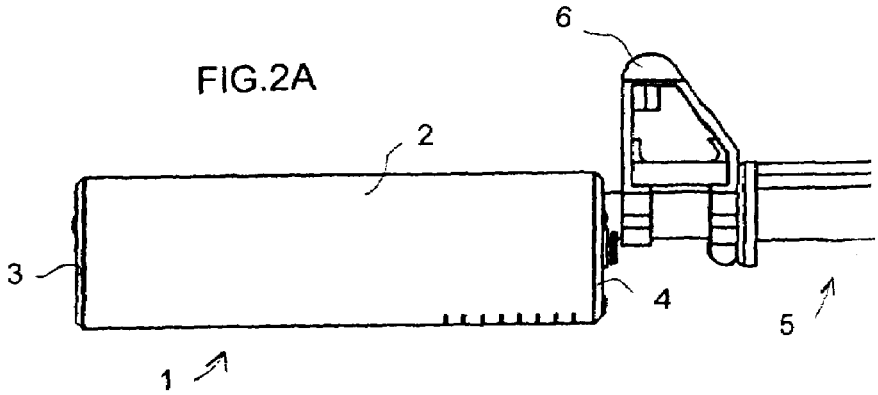
Figure 2C:
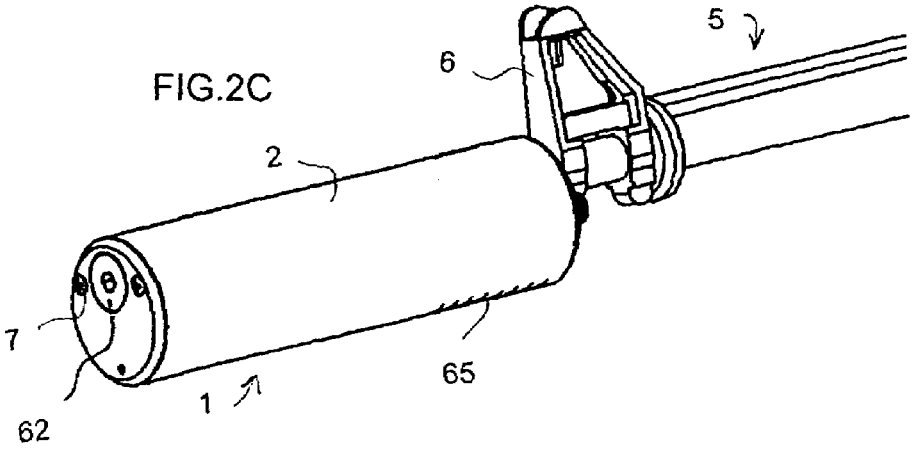
Figure 3:
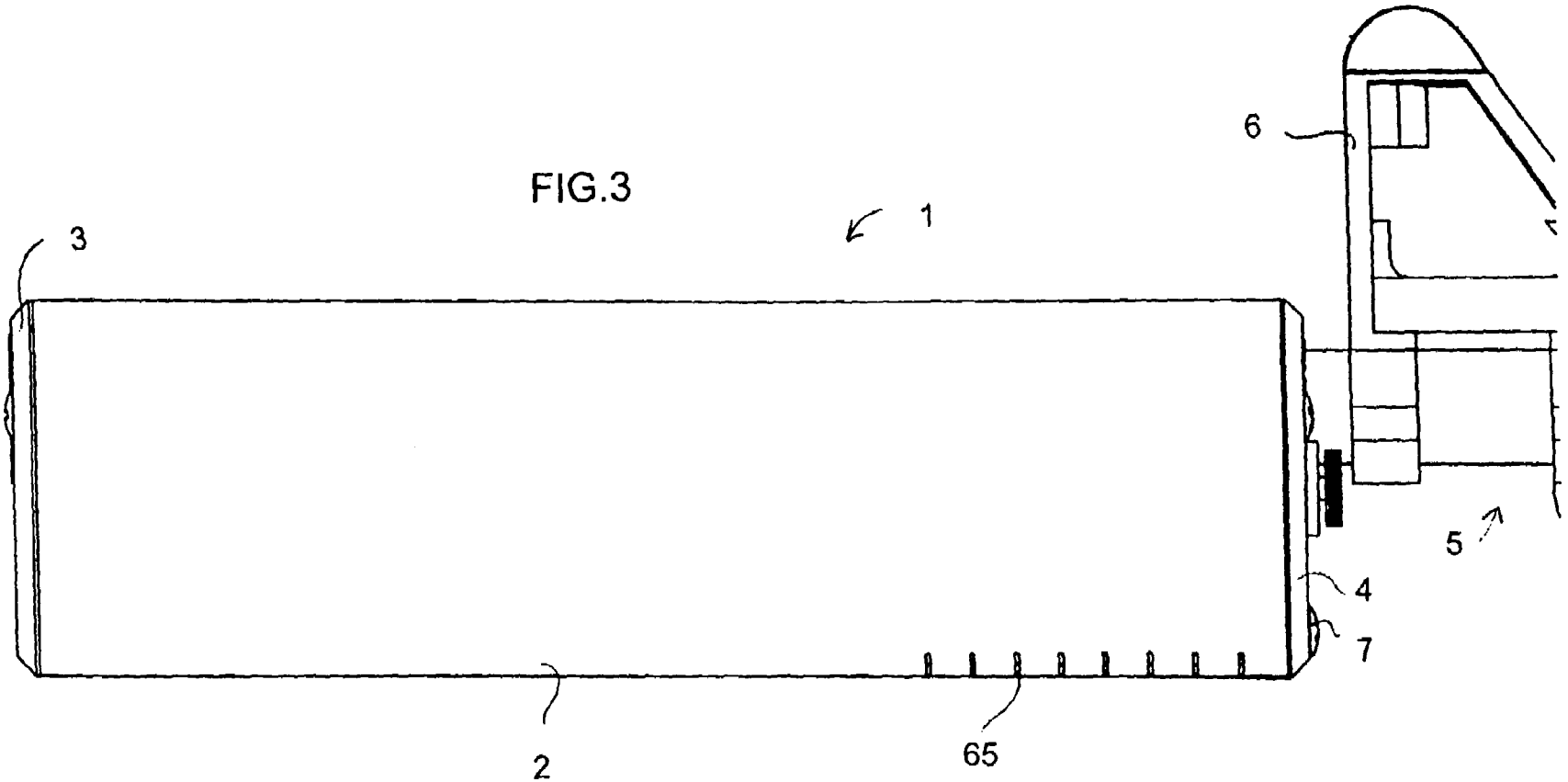
FIGS. 3-6 are respective side-elevational, bottom-plan, front-elevational and perspective views of the firearm suppressor in the assembled and mounted condition.
Figure 4:
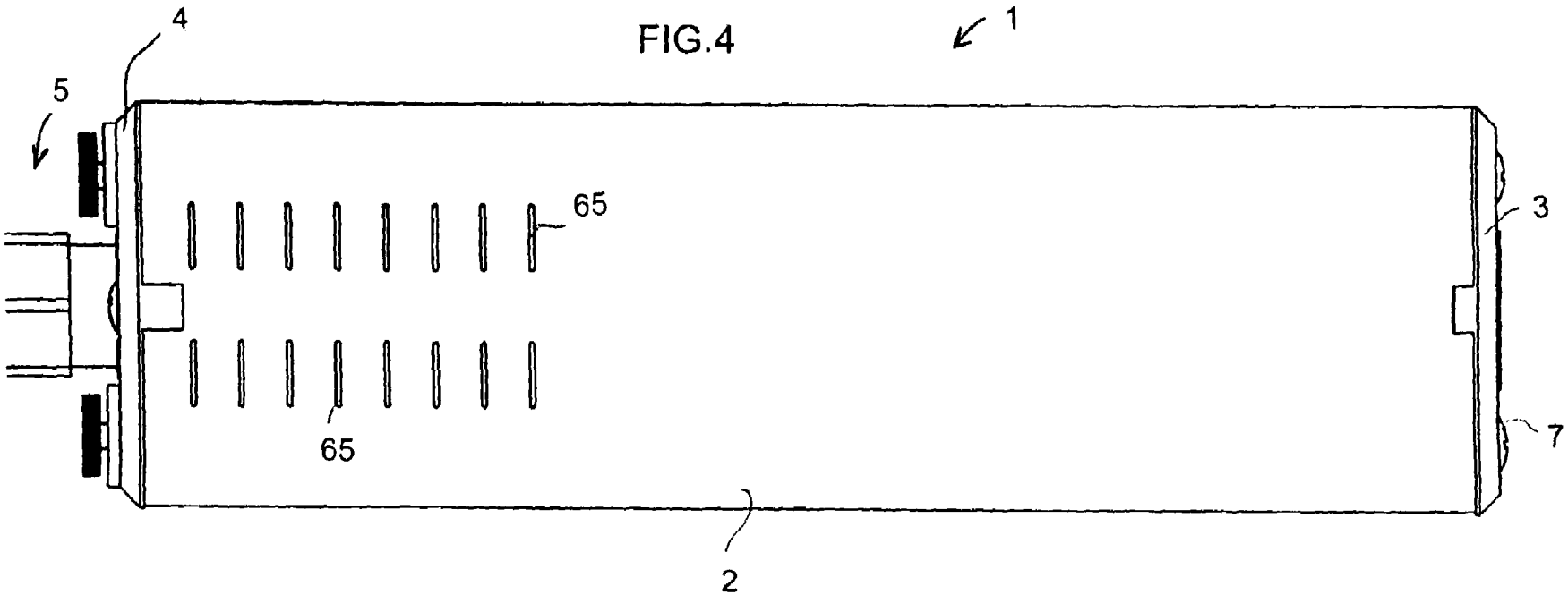
Figure 5:
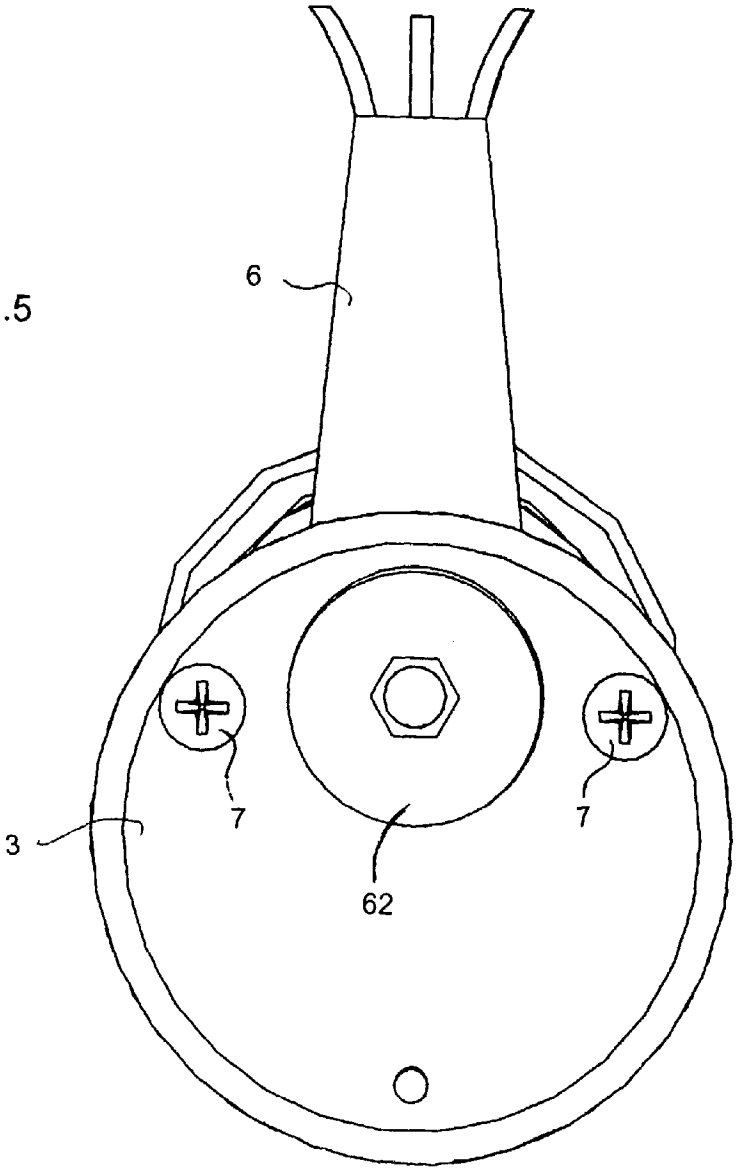
Figure 6:
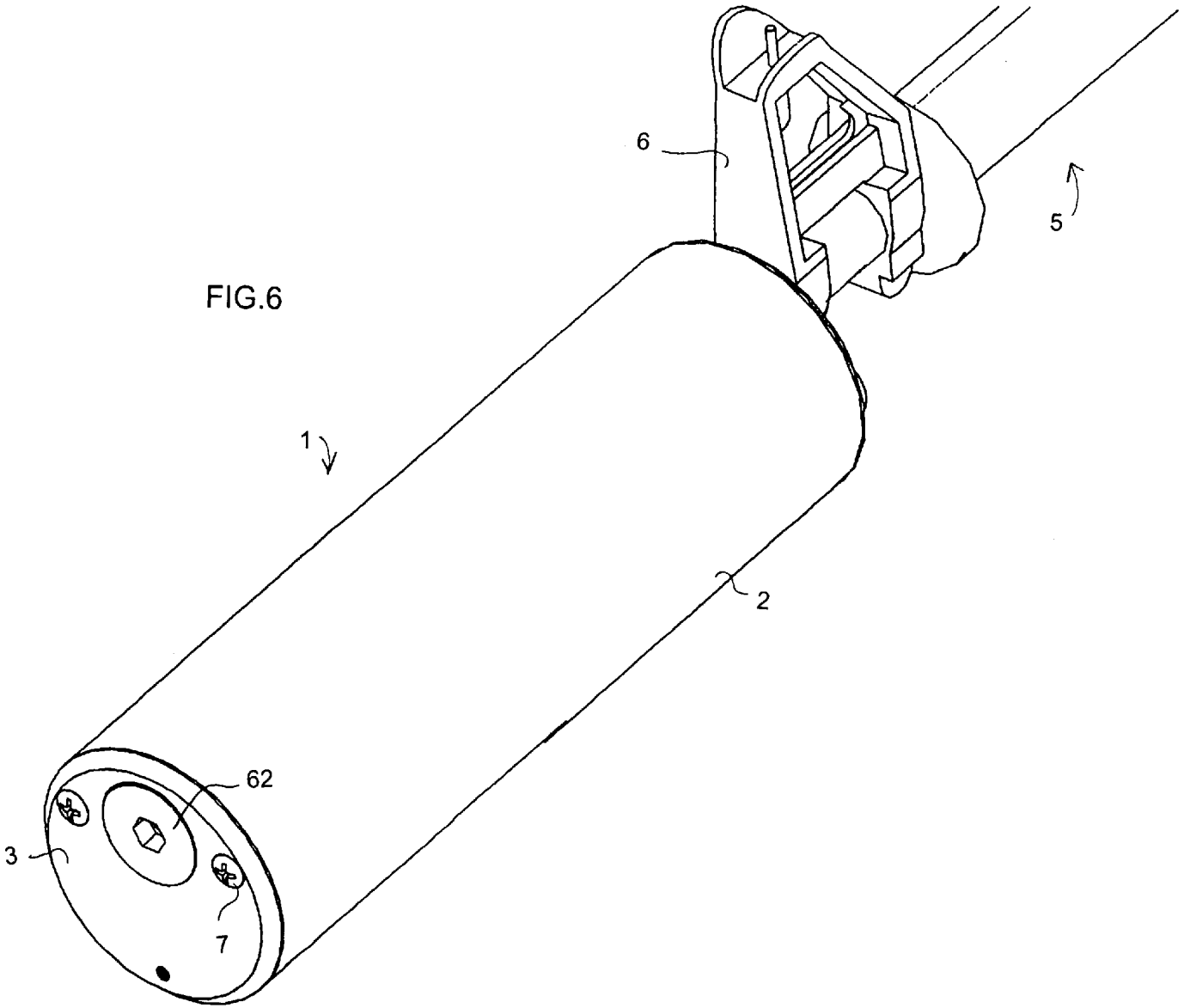
Figure 7:
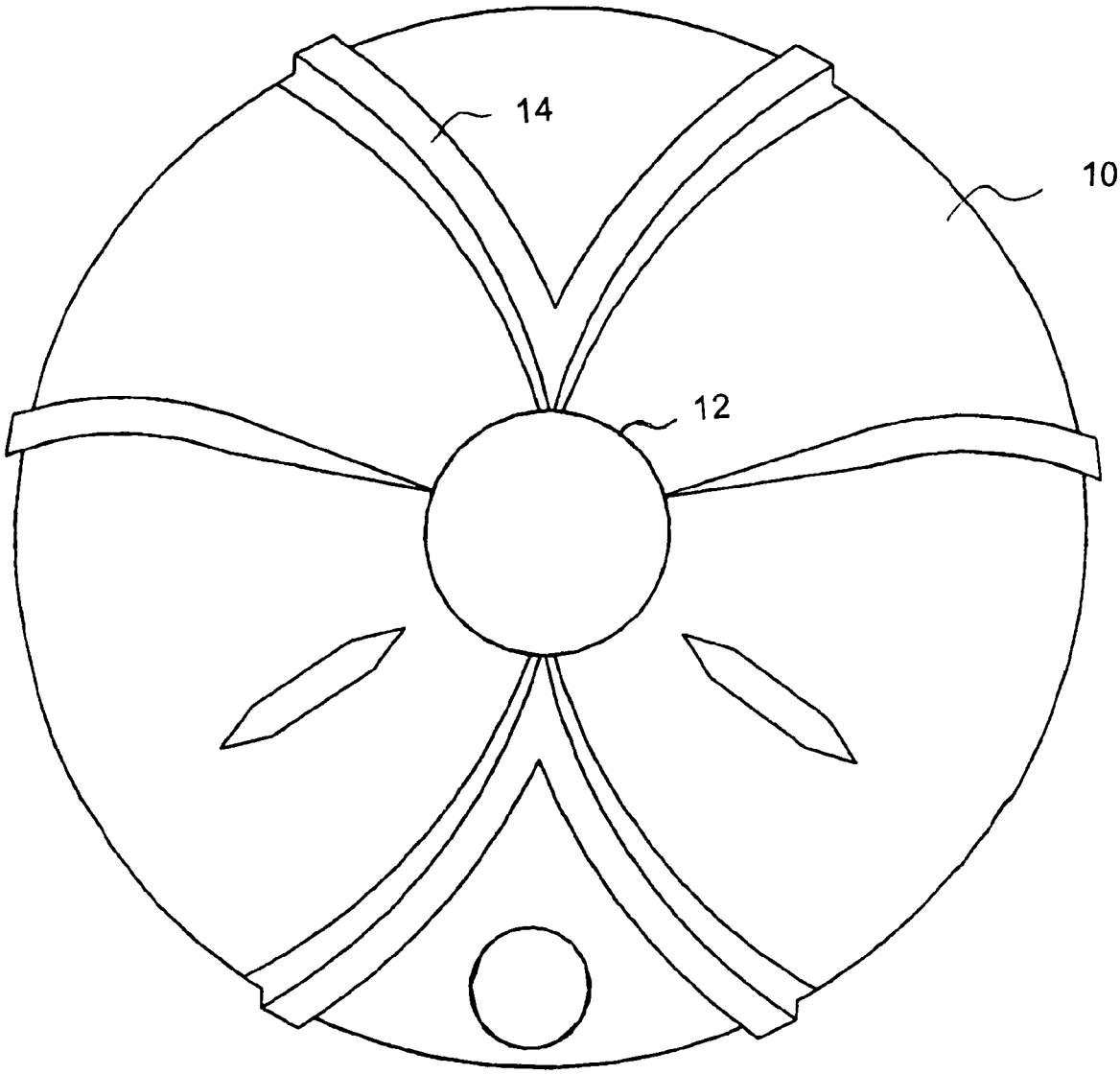
FIGS. 7-10 are respective enlarged rear-elevational, bottom-plan, side-elevational and perspective views of a stripper cone.
Figure 8:
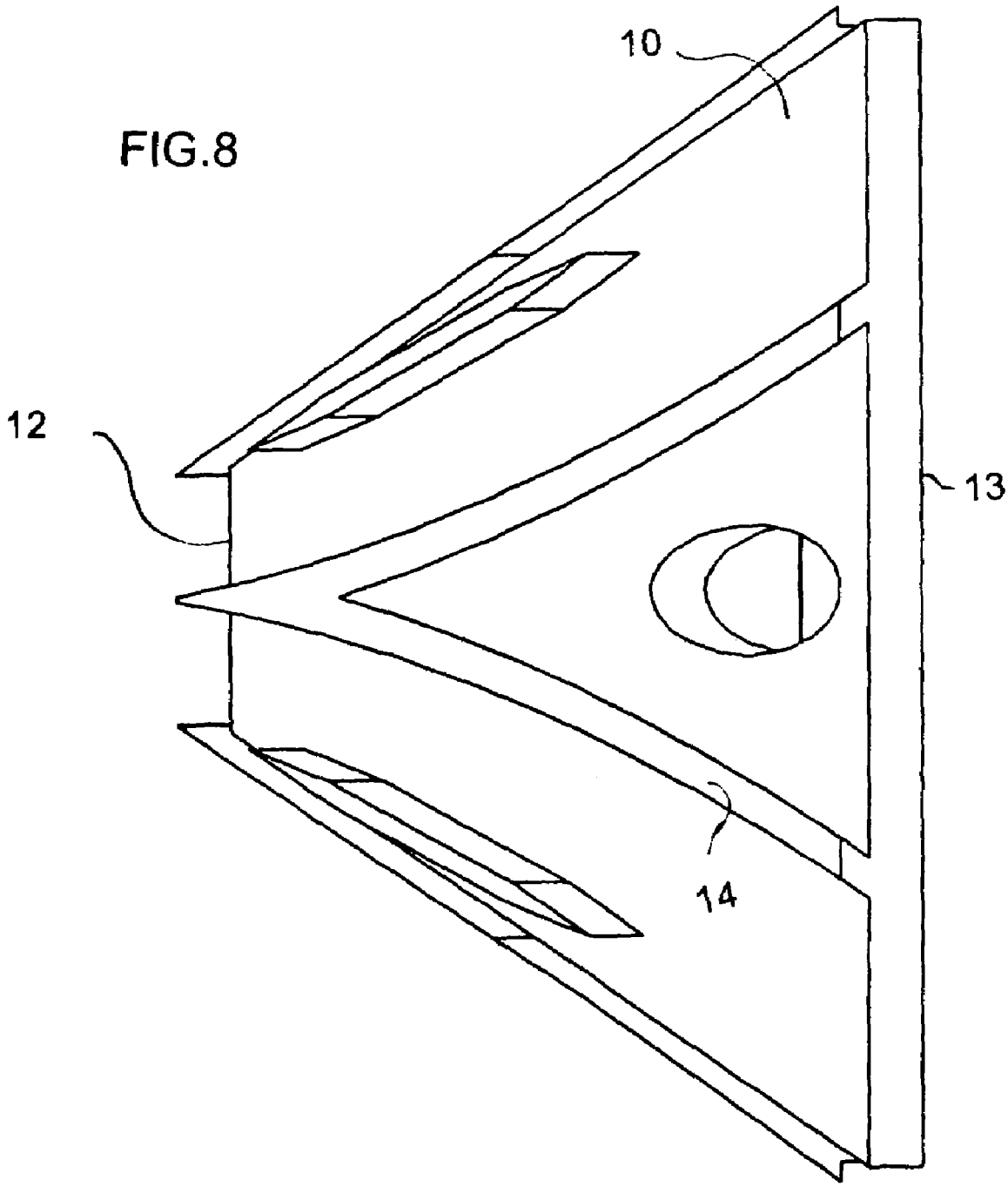
Figure 9:
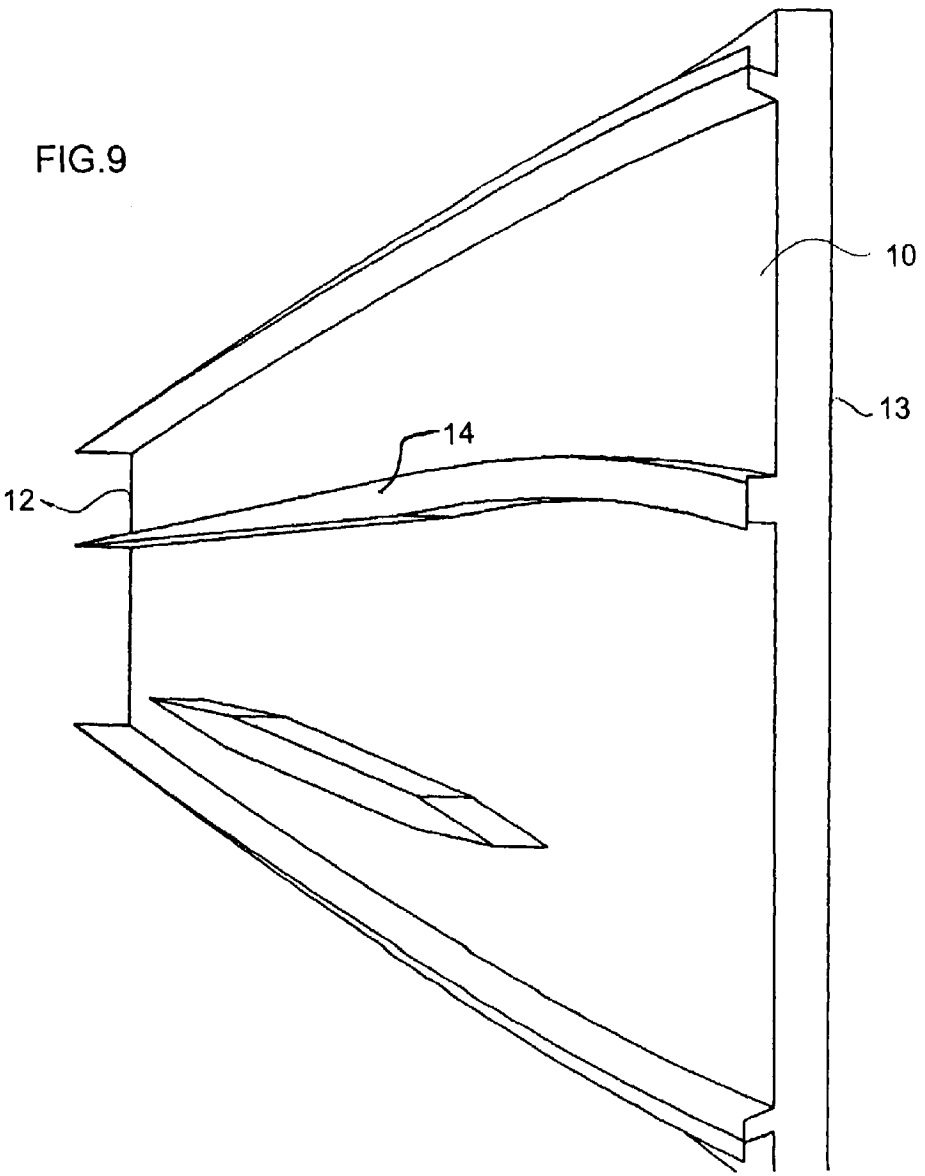
Figure 10:
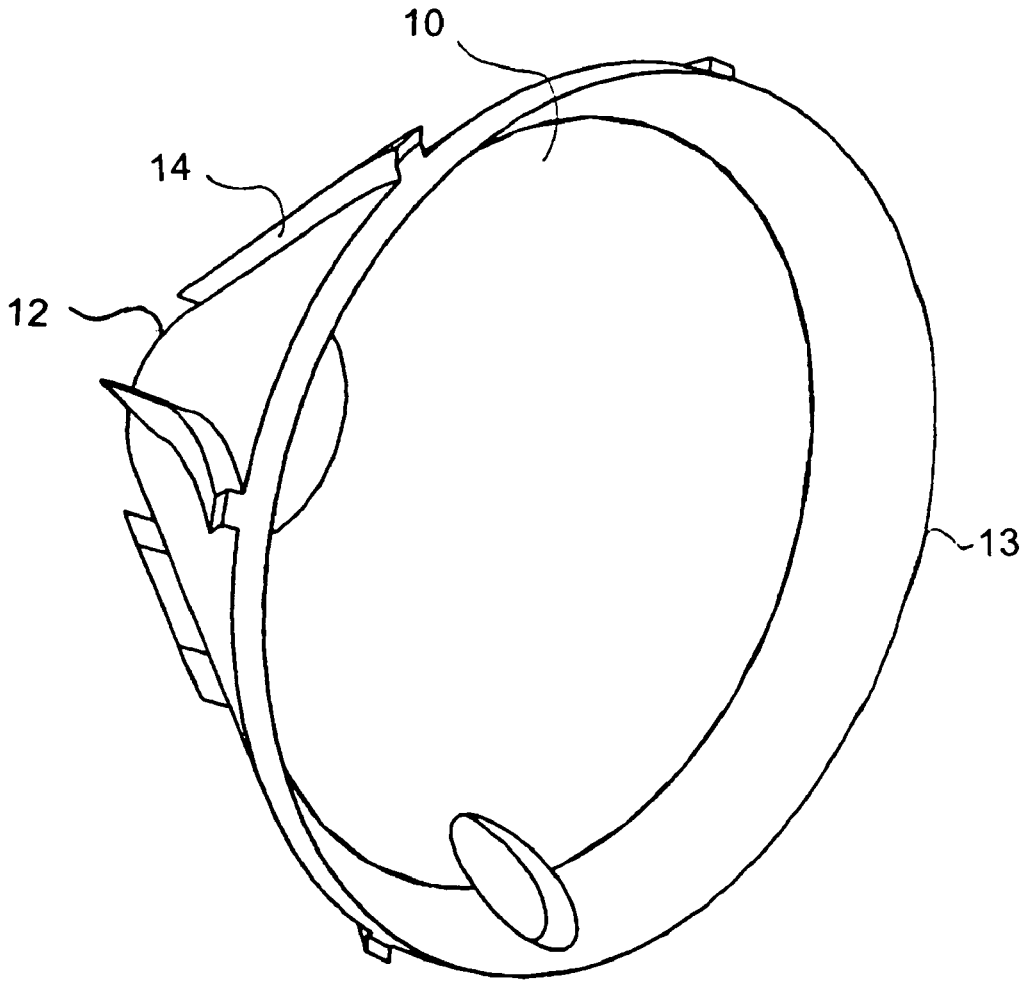

Referring now to the figures of the drawings in detail and first, particularly, to FIGS. 1A-1E thereof, there is seen a firearm suppressor 1 in an assembled but dismounted condition, having a cover or housing 2 with a front end cap 3, a rear end cap 4 and vents 65. FIGS. 2A-2C and FIGS. 3-6 show the suppressor 1 mounted on a firearm 5 having a sight 6.

Figure 11:
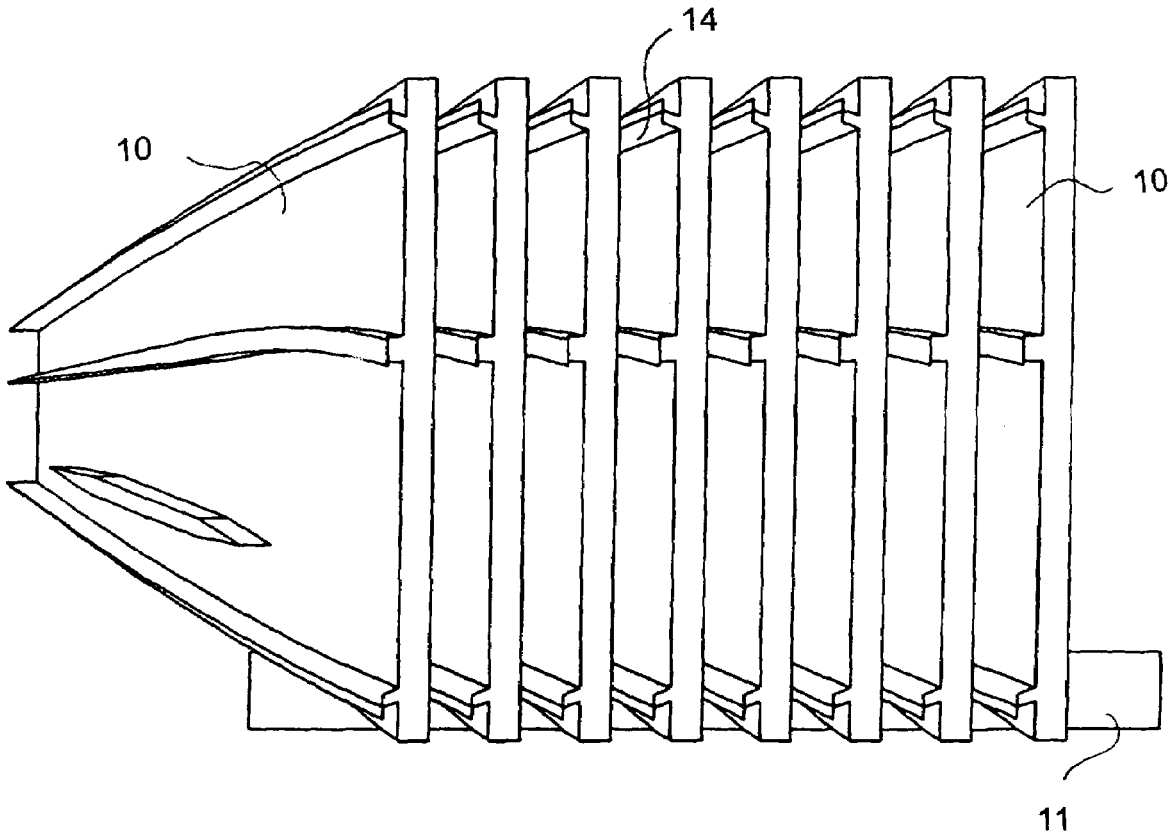
FIGS. 11 and 12 are respective side-elevational and perspective views of assembled stripper cones with a stabilizer bar.
Figure 12:
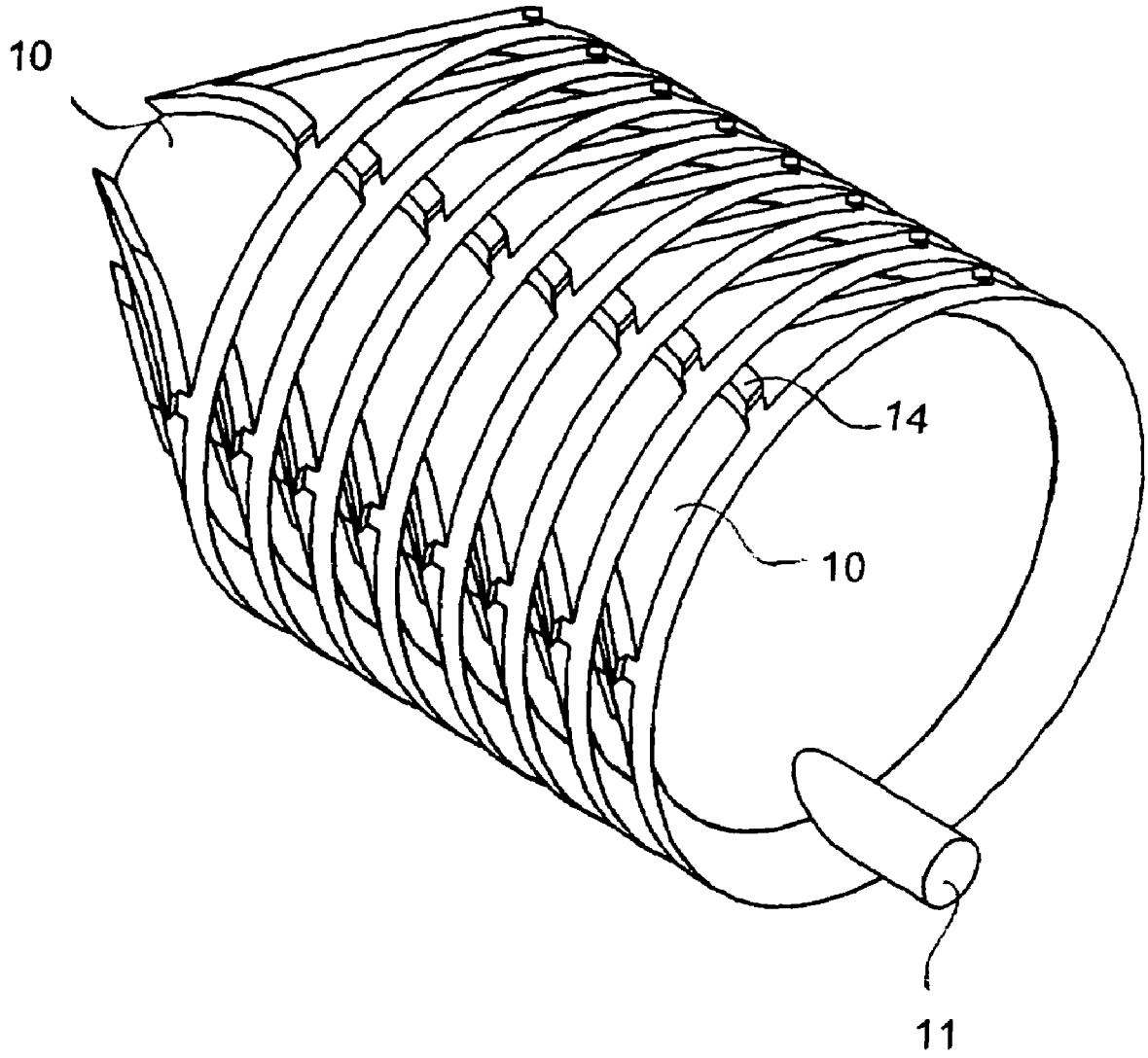

FIGS. 7-10 illustrate a stripper member or cone according to the invention, whereas FIGS. 11 and 12 show eight stripper members or cones 10 assembled with a stabilizer bar 11 within an interior or lumen 2' of the housing or cover 2. The stripper cones 10 engage and deflect quickly expanding gases in their forward and angular trajectory. The stripper cones 10 have sharpened upstream edges 12 for catching and deflecting a gas stream into the stripper cones and rounded downstream edges 13 providing aerodynamic surfaces or airfoils for pulling additional gas into the stripper cones 10 acting as a gas trap. The stripper cones 10 additionally have laterally curved spacing ridges 14 between the cones, which not only to maintain cone spacing as seen in FIGS. 11 and 12, but also steer the gases in laterally curving arcs to decrease the angle of impact with the wall of the cover or housing 2.

Figure 13:
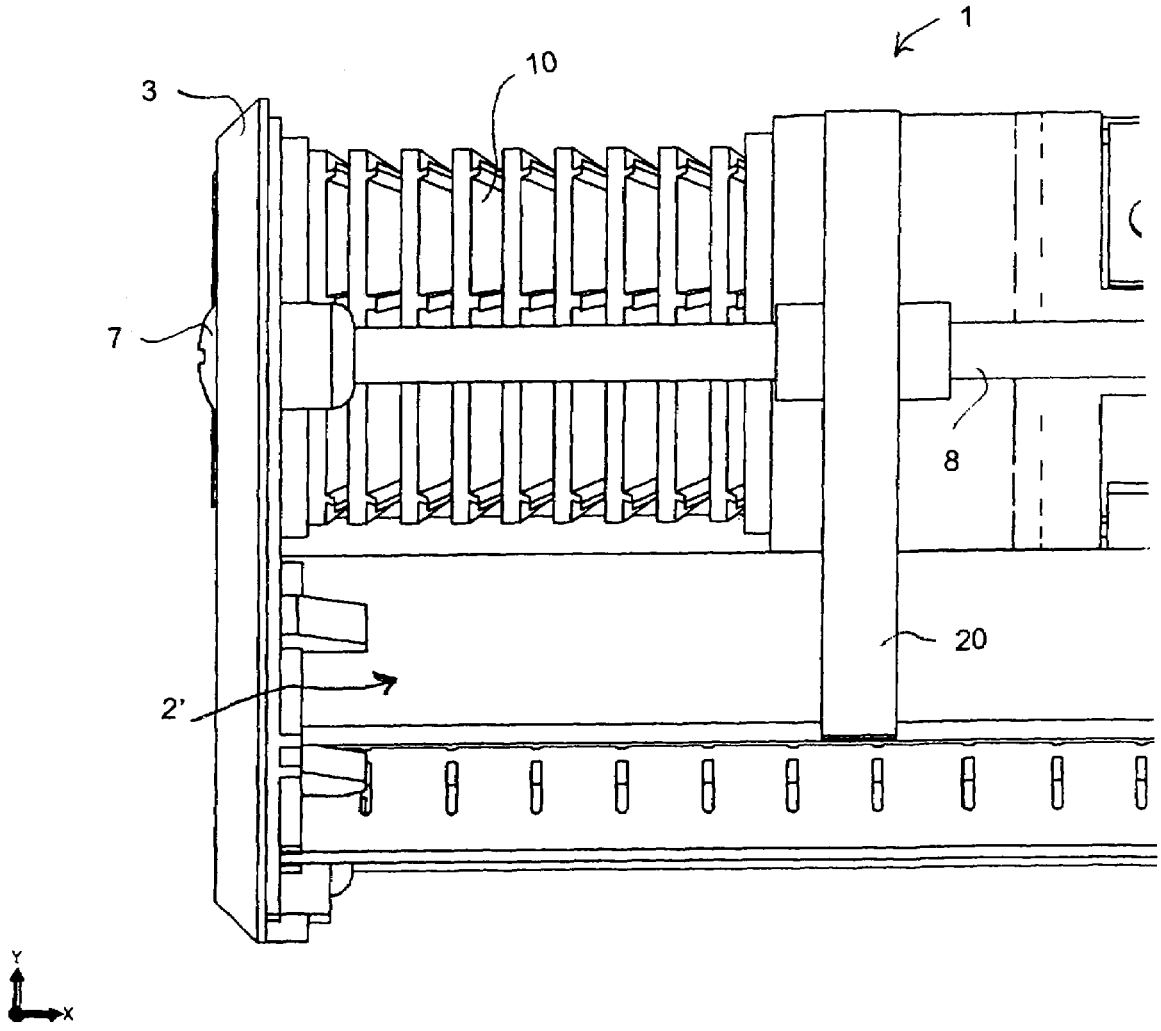
FIGS. 13 and 14 are respective fragmentary side-elevational and perspective views of the stripper cone region without a live hinge collar.
Figure 14:
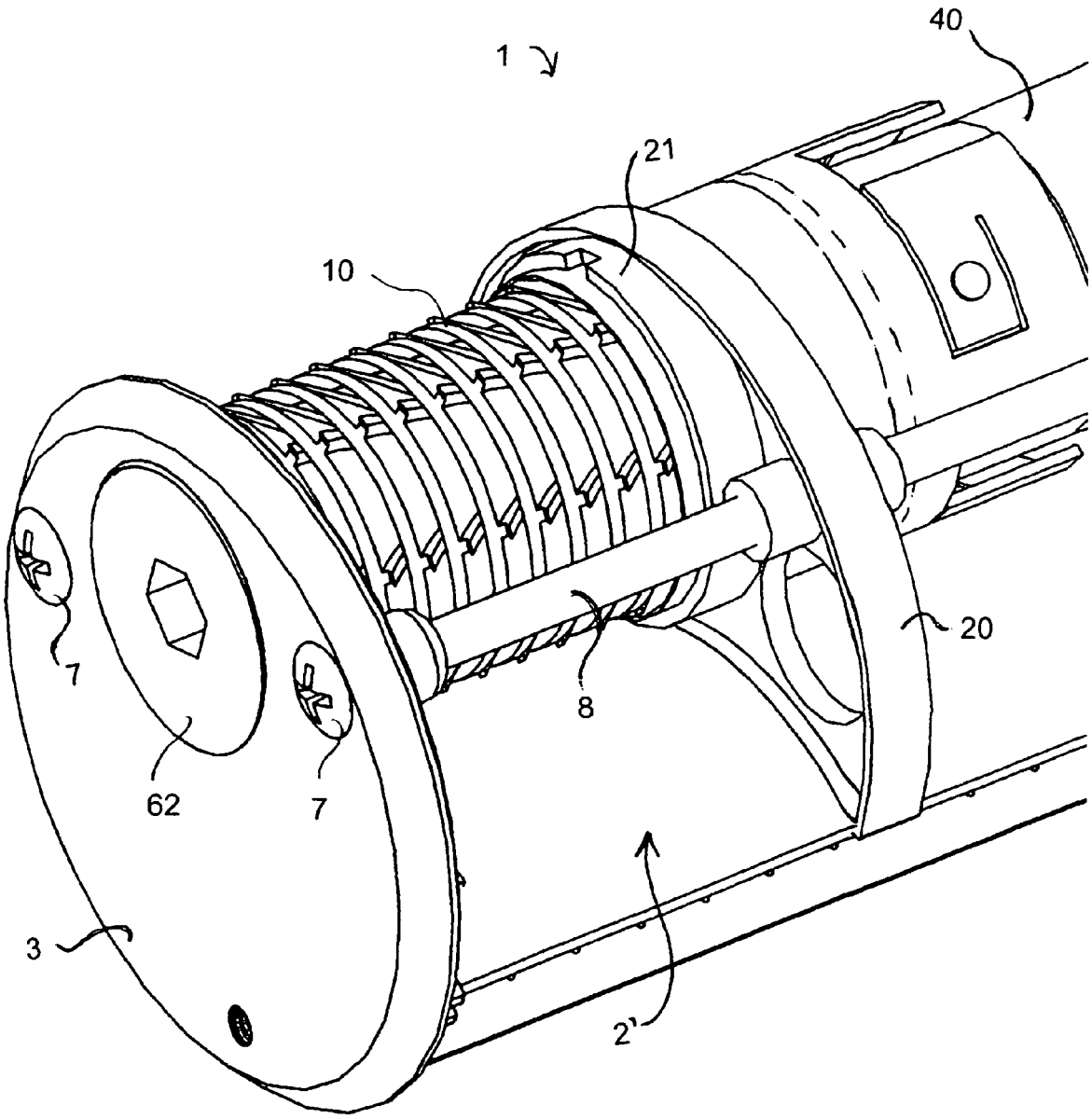
Figure 15A:
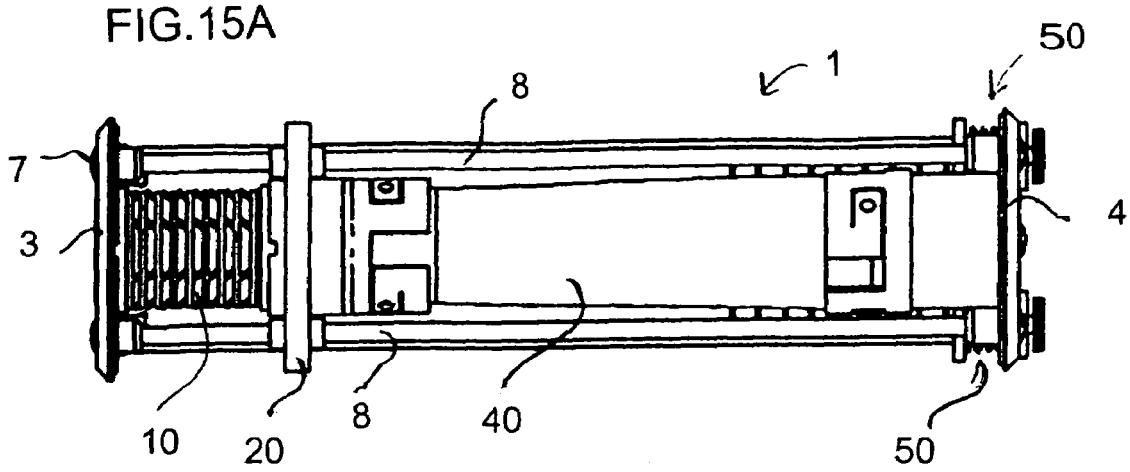
FIGS. 15A-15C are respective top-plan, side-elevational and perspective views of the firearm suppressor with the cover or housing removed.
Figure 15B:
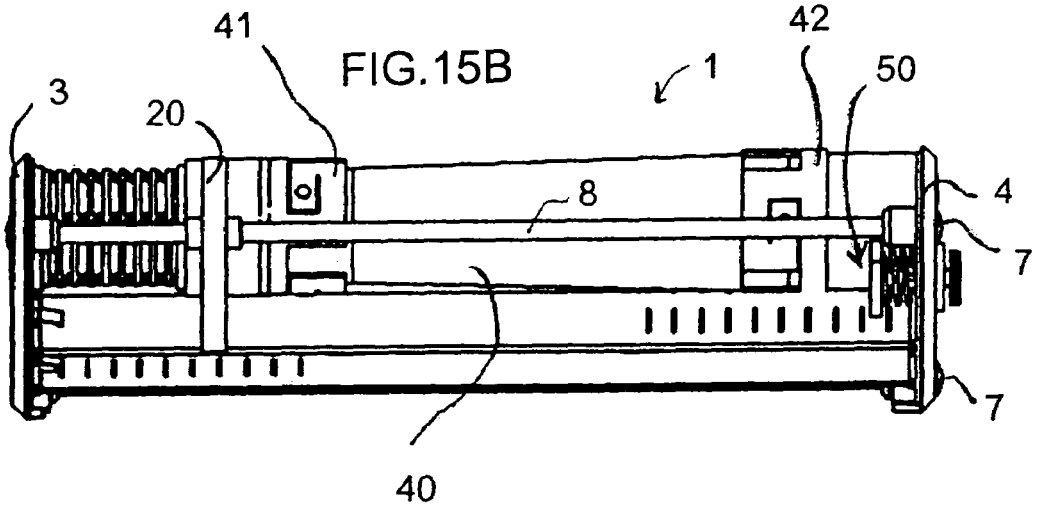
Figure 15C:
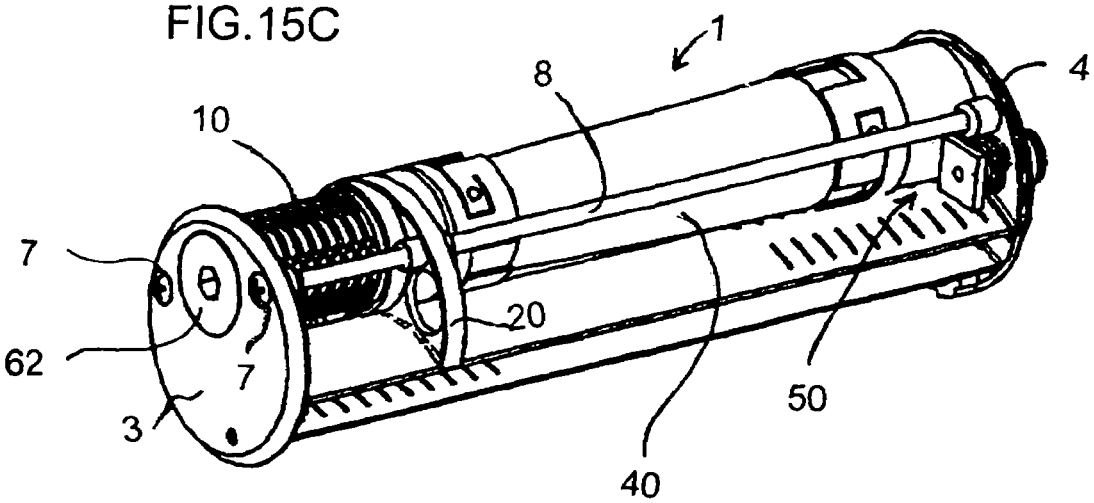
Figure 16:
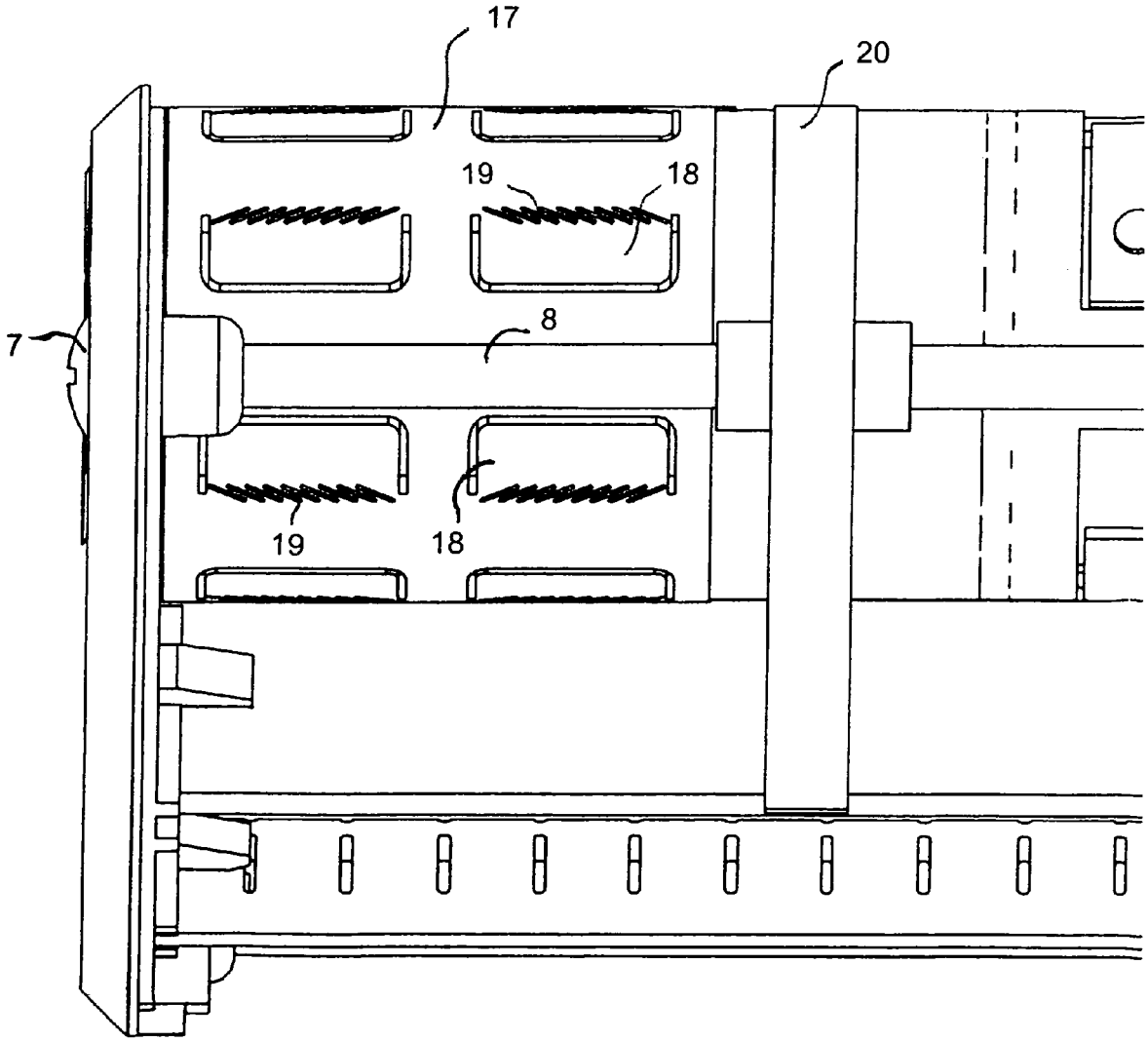
FIGS. 16-18 are respective fragmentary side-elevational, top-plan and perspective views of the stripper cone region with the live hinge collar in place.
Figure 17:
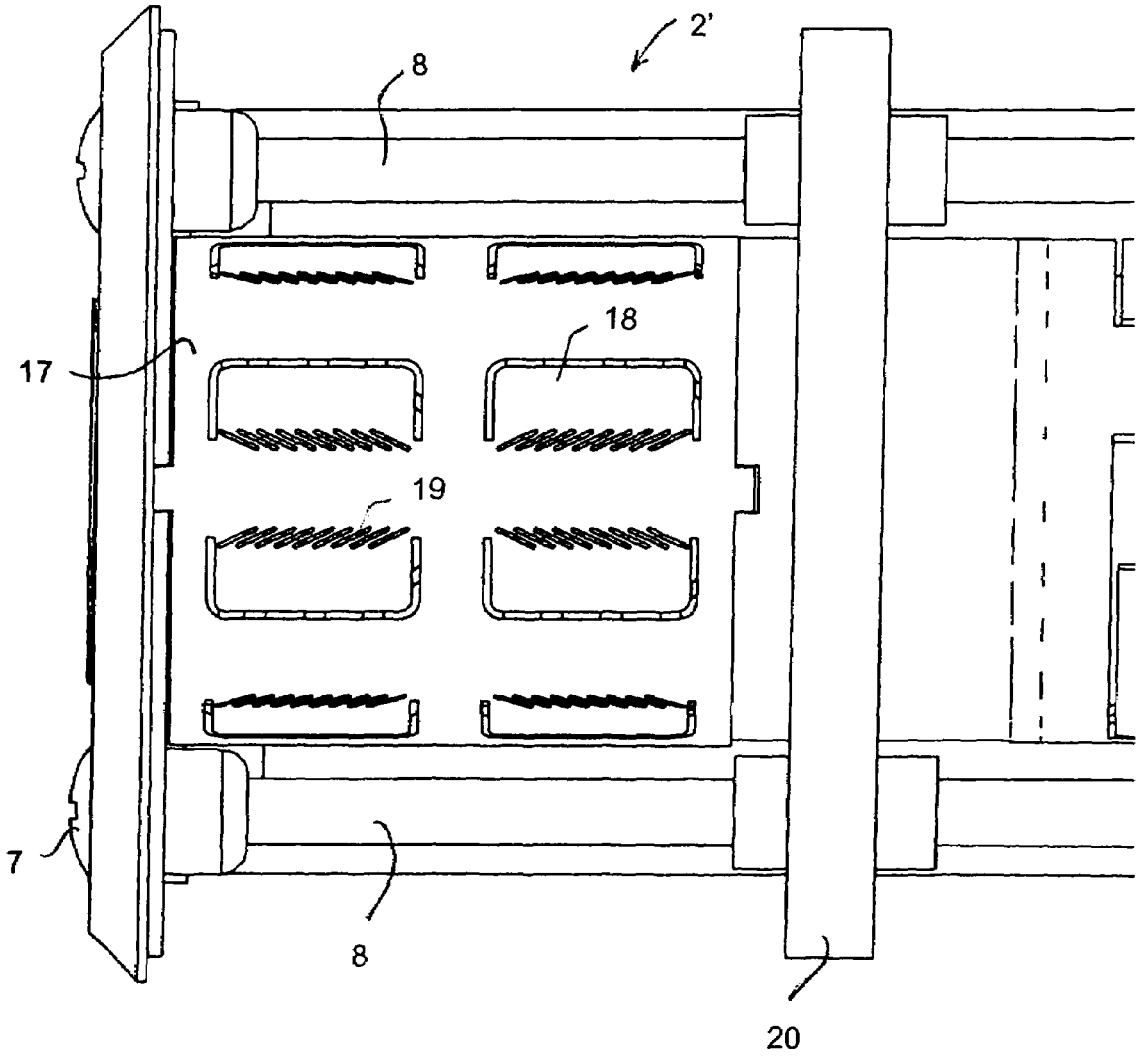

FIGS. 13 and 14 show the stripper cones 10 assembled in place within a portion of the interior or lumen 2' of the housing or cover 2 of the suppressor 1, directly upstream of the front end cap 3, with the cover or housing 2 removed. FIGS. 15A-15C show the entire suppressor 1 with the cover or housing 2 removed and therefore illustrate the rear end cap 4 as well.

Several of the previously-described figures as well as FIGS. 13, 14 and 15A-15C show screws 7 at both the front and rear end caps 3, 4. The screws 7 are threaded into two tie rods 8, as is best seen in FIG. 15A, for holding the suppressor 1 together. FIGS. 13, 14, FIGS. 15A-15C, 16-18 and 19A-19D show a middle support member 20 and FIGS. 15A-15C also show a main support tube 40 and pressure release vents 50, which will be explained in more detail below.

A live hinge collar 17 can be seen in FIGS. 16-18 and 19A-19D to be disposed in the region of the stripper cones 10, upstream of the front end cap 3 and surrounding the stripper cones 10. The live hinge collar 17 has a plurality of one-way flow elements in the form of live-hinge valves 18 with live hinges 19 that permit the valves to lift easily as the deflected gases flow in a gas flow direction indicated by arrows in FIG. 18.

Figure 18:
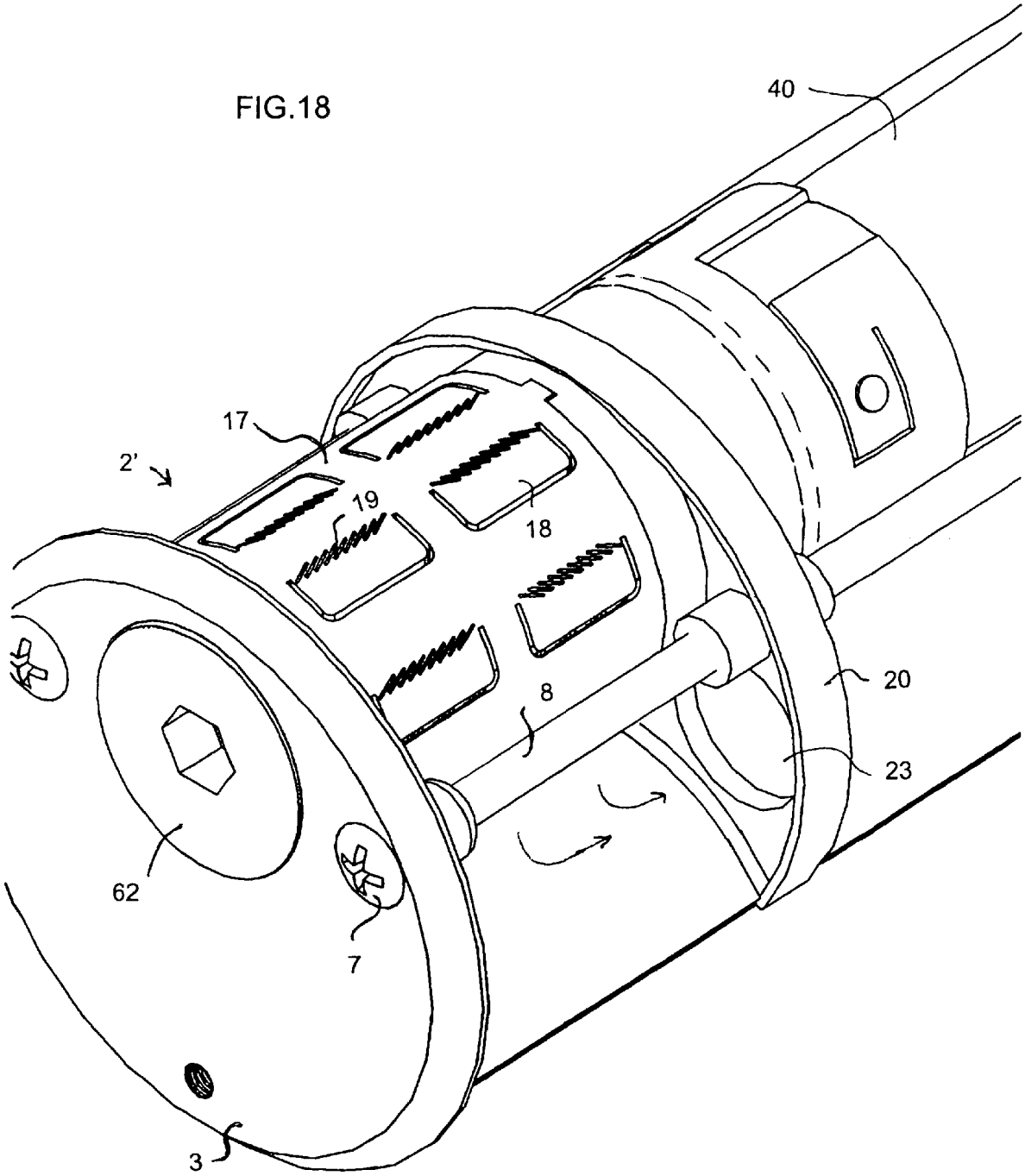
Figure 19A:
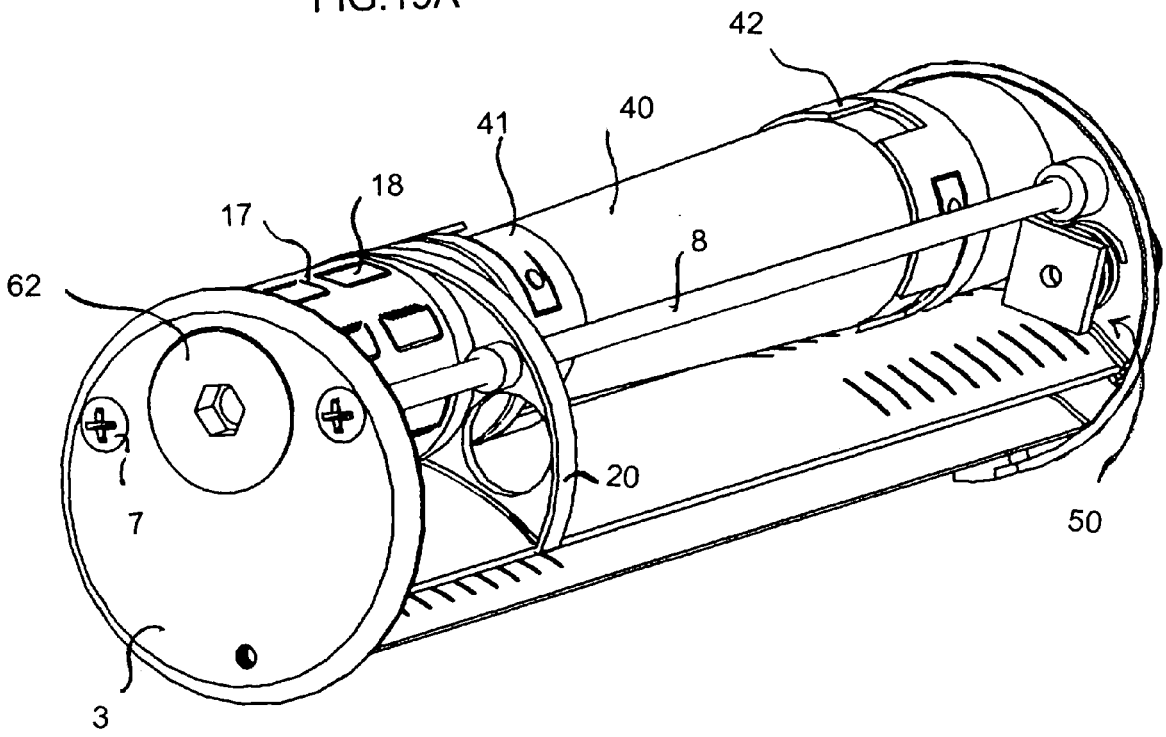
FIGS. 19A-19D are respective and reduced top-plan, side-elevational and perspective views of the firearm suppressor with the cover or housing removed but the live hinge collar in place.
Figure 19B:
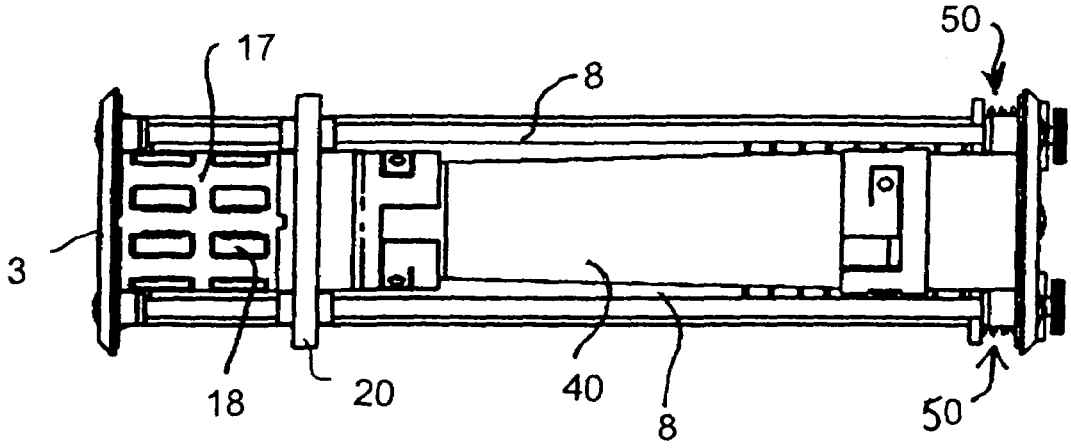
Figure 19C:
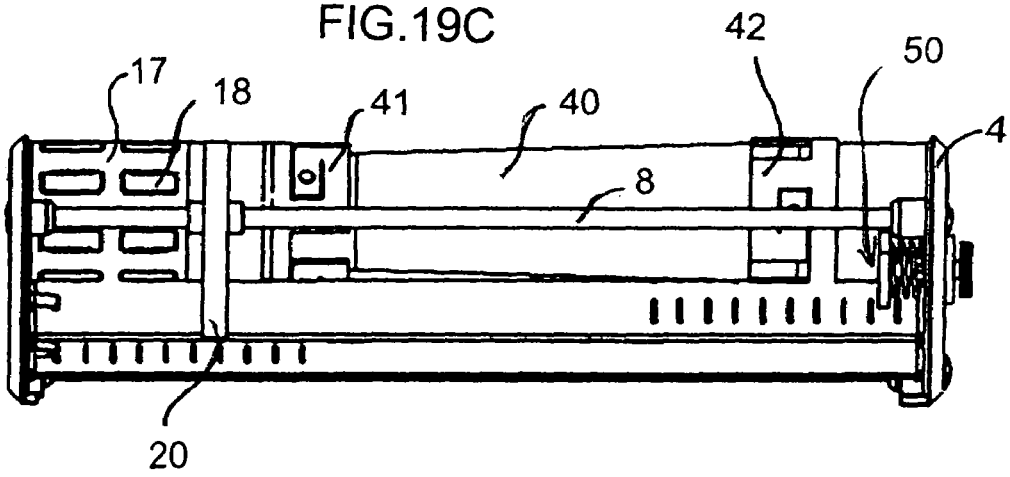
Figure 19D:
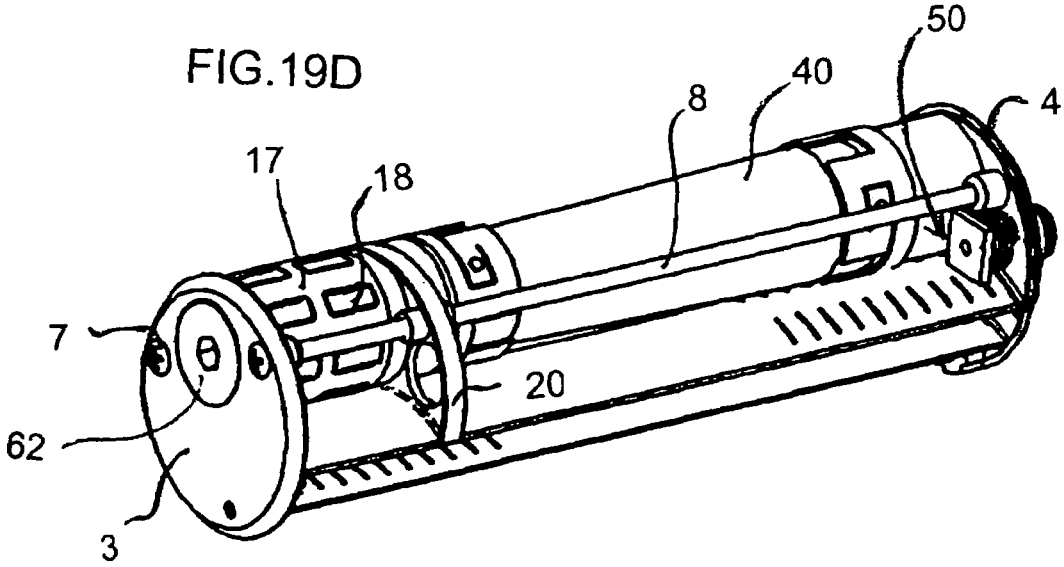
Figure 20:
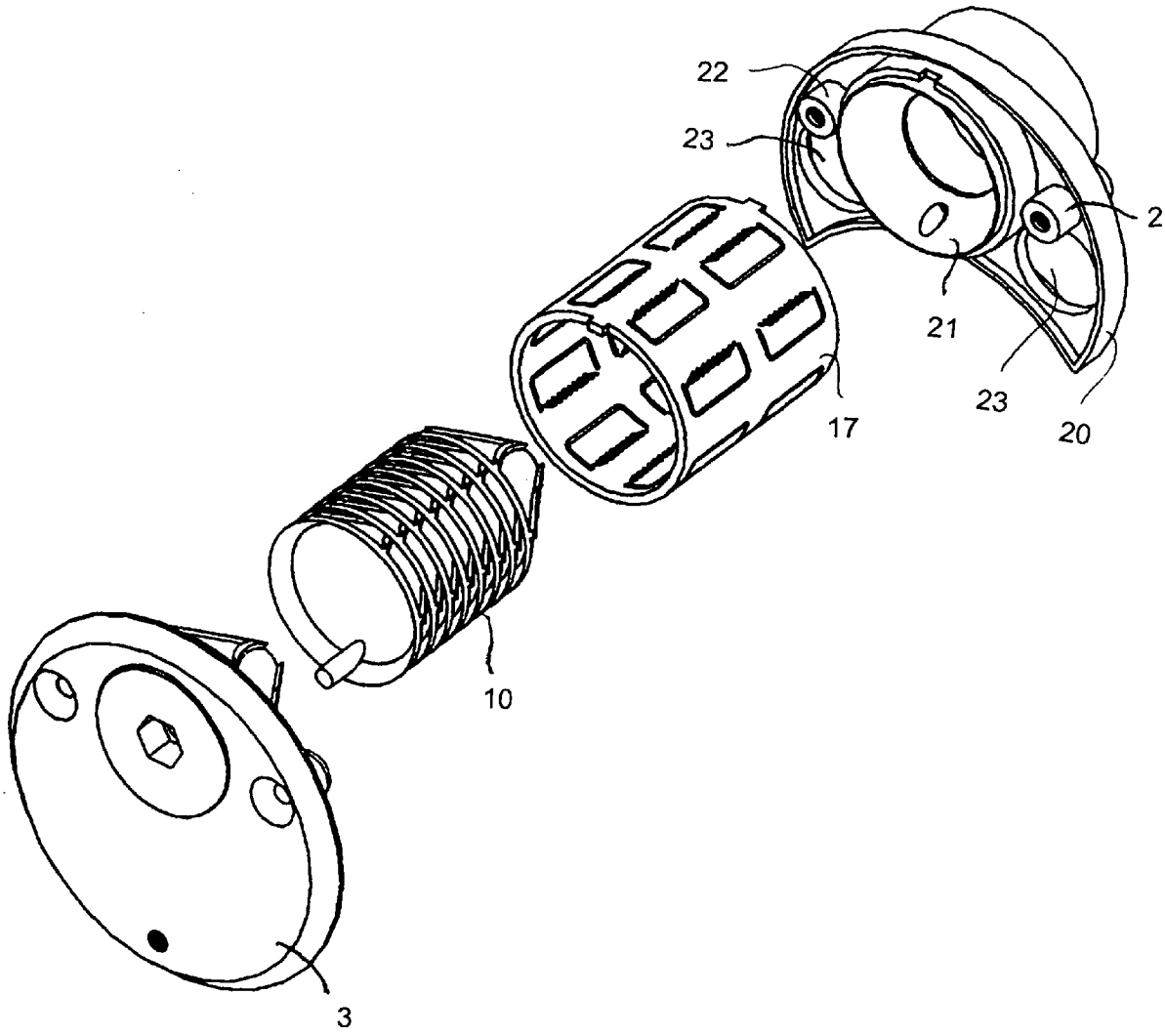
FIG. 20 is an exploded perspective view of the front cap, stripper cones, live hinge collar and middle support member of the firearm suppressor.
Figure 21:
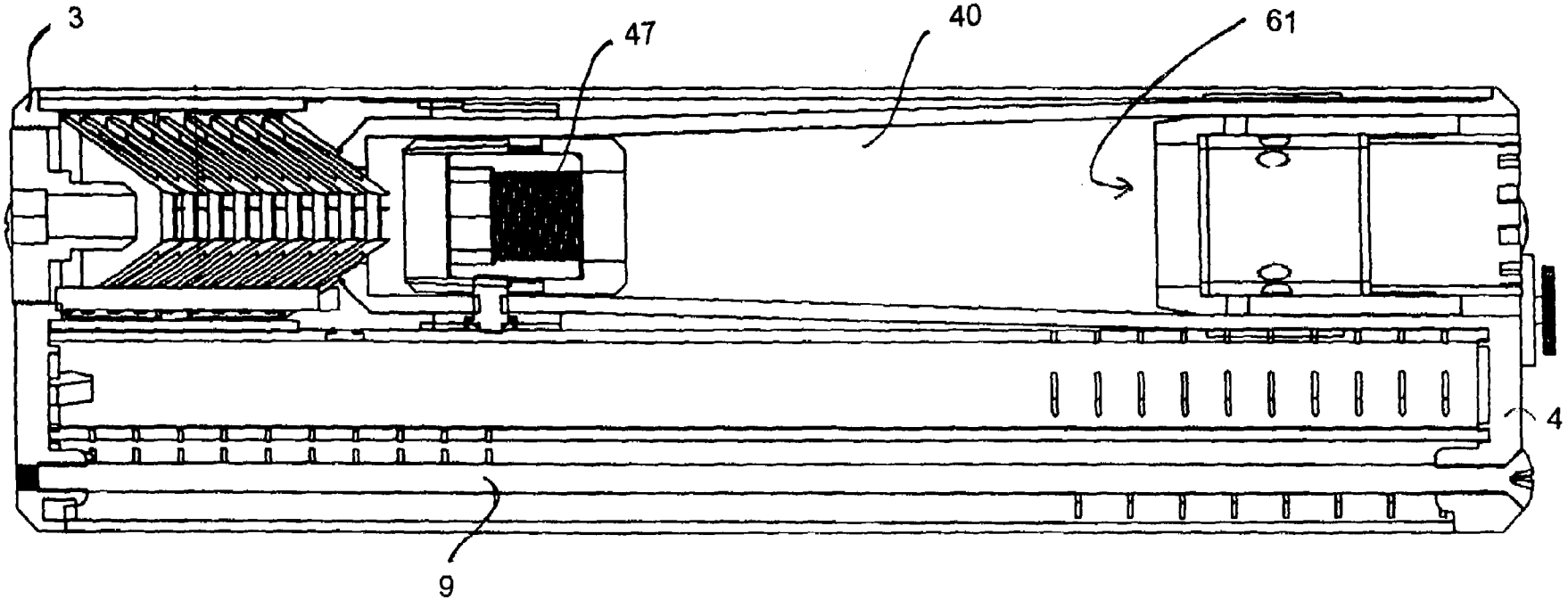
FIG. 21 is a side-elevational view of the mid-sectional region of the firearm suppressor with the cover or housing removed.

The exploded view of FIG. 20 shows how the front end 3, stripper cones 10, live hinge collar 17 and the middle support member 20 are disposed relative to one another. It can also be seen that the middle support member 20 has a sleeve 21 for receiving the furthest upstream stripper cone 10 and the main support tube 40. The middle support member 20 additionally has internally threaded collars 22 for receiving external threads on ends of two sections of the two lateral tie rods 8. However, FIG. 21 shows that a lower tie rod 9 is formed in one piece and screwed between the end caps 3, 4. The middle support member 20 furthermore has openings 23 for receiving a partial diversion of the gases passing between the stripper cones 10 and through the live-hinge valves 18, as is shown in FIG. 18.

Figure 22:
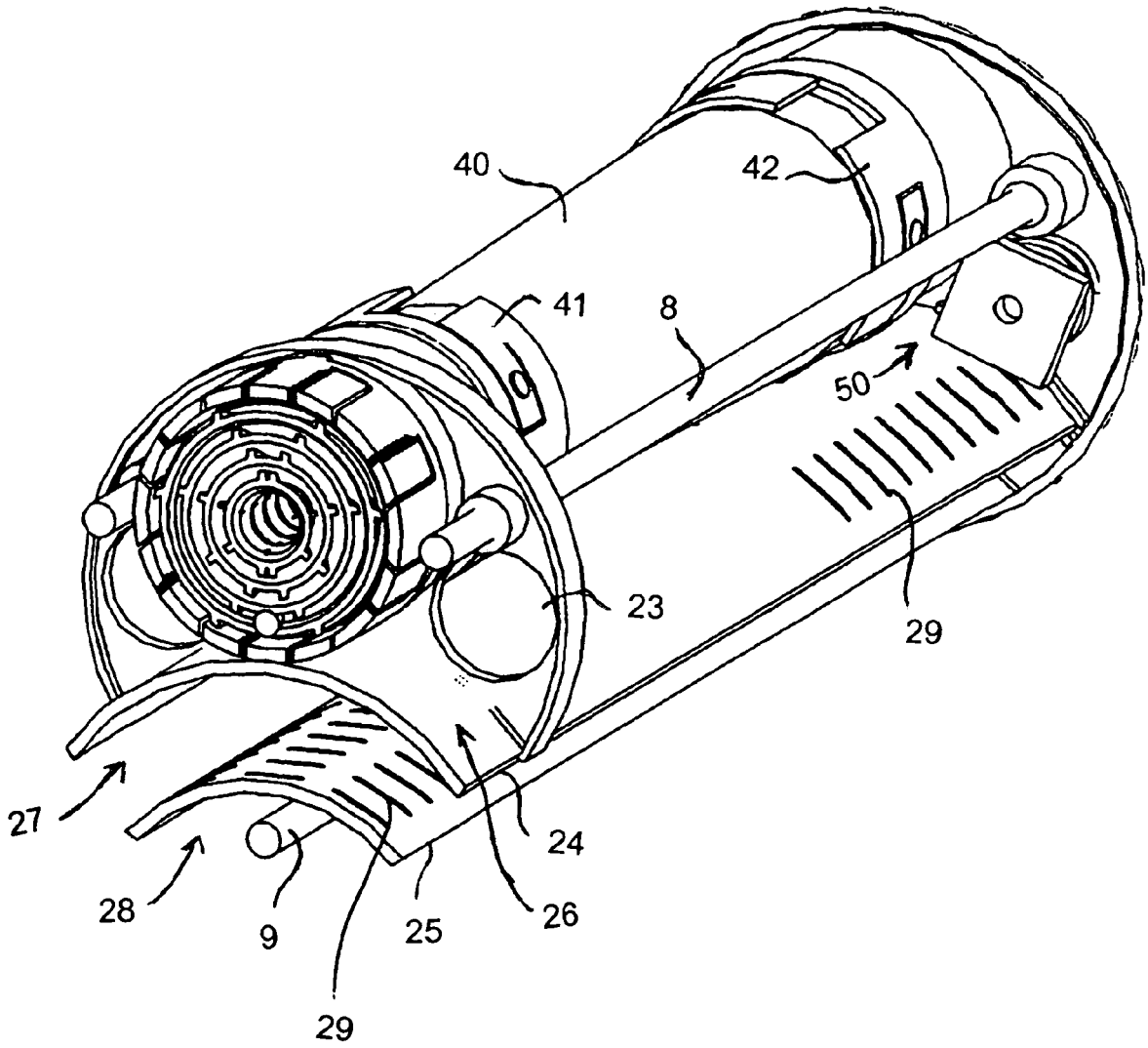
FIG. 22 is a perspective view of the firearm suppressor showing the stripper cones, vent valves and triple decompression chambers.
Figure 23:
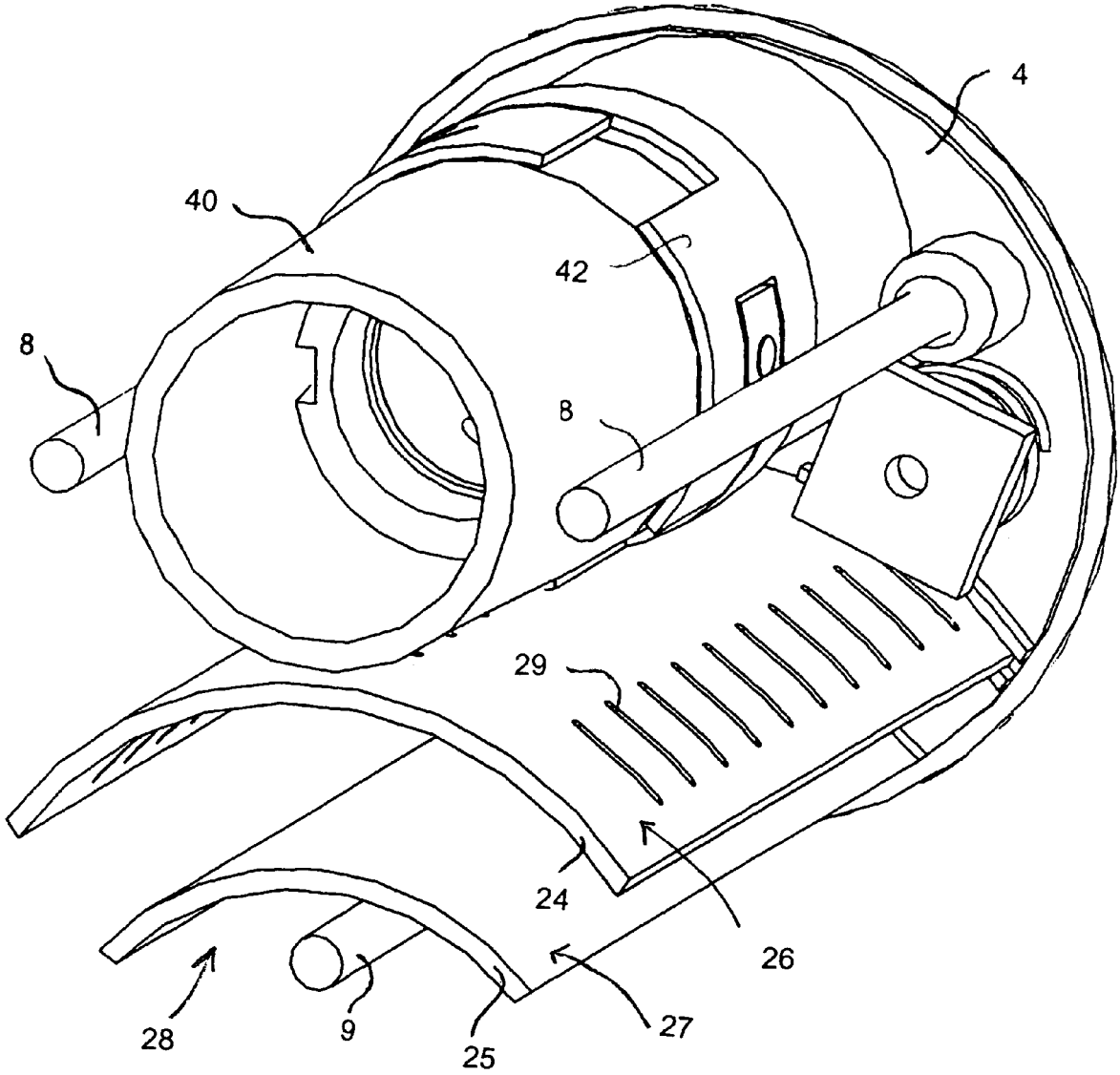
FIG. 23 is a fragmentary perspective view of the firearm suppressor showing the vent valves and triple decompression chambers but with the stripper cones removed.
Figure 24A:
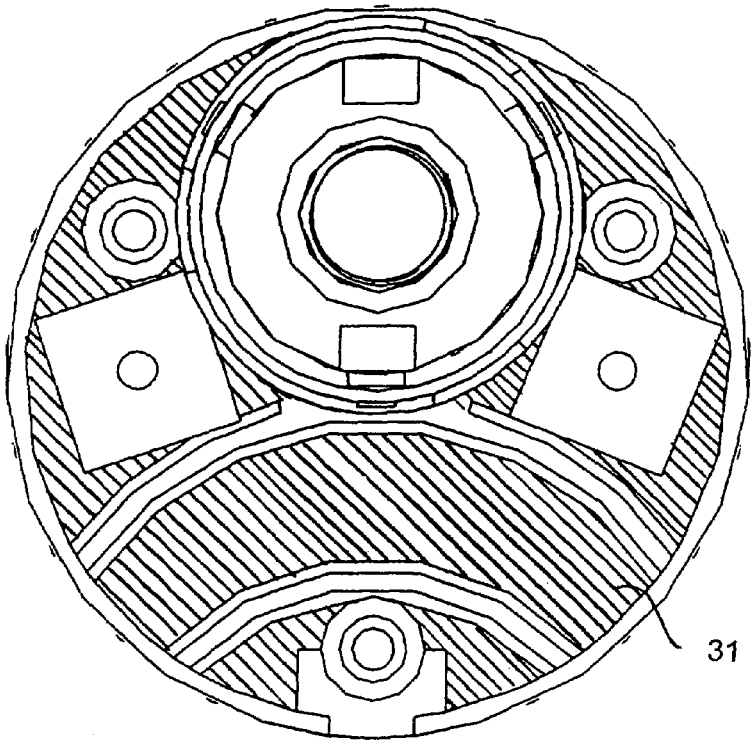
FIGS. 24A and 24B are respective front-elevational and enlarged side-elevational views of the end cap showing the faceted surface and facets.
Figure 24B:
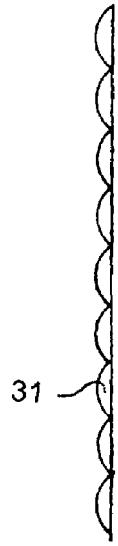
Figure 25:
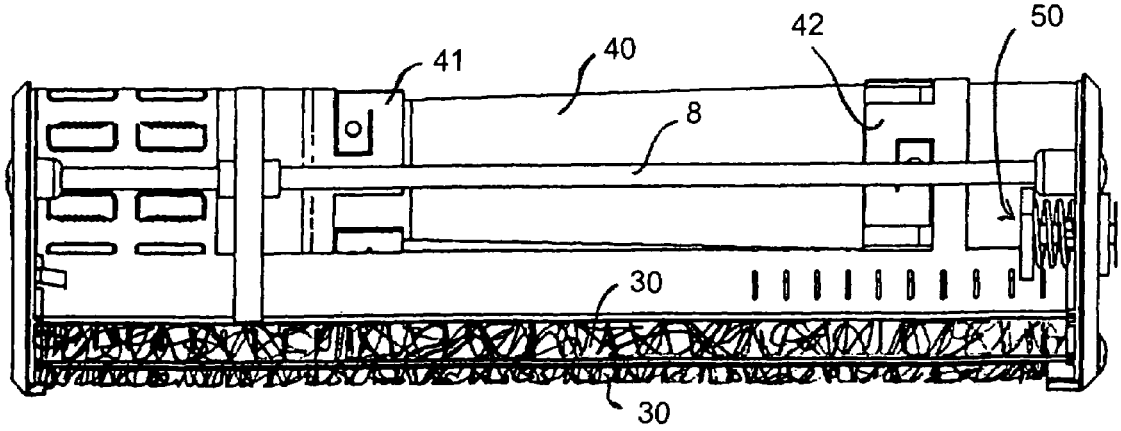
FIG. 25 is a side-elevational view of the firearm suppressor with the cover or housing removed but showing steel wool in the second and third decompression chambers.
Figure 26:
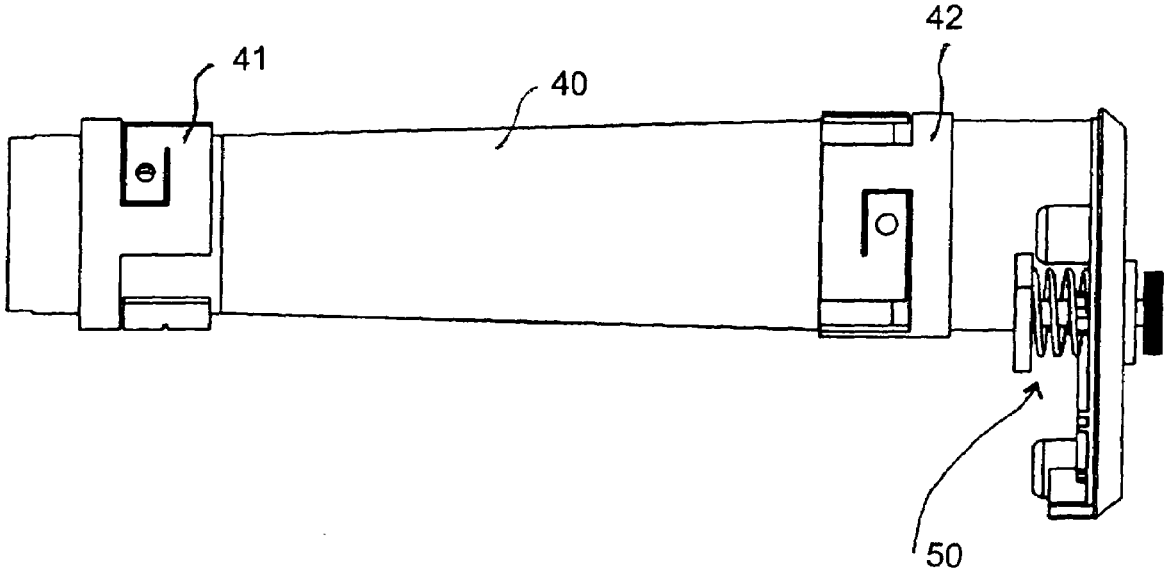
FIG. 26-29 are respective side-elevational, top-plan, fragmentary, enlarged rear-perspective and fragmentary, enlarged front-perspective views of the main support tube and pressure release vents.
Figure 27:
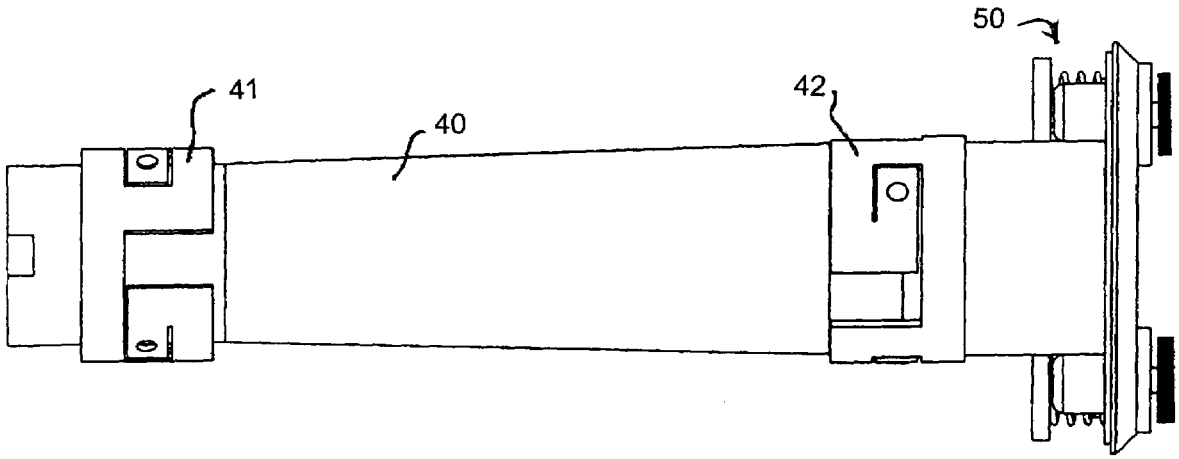

It may be seen from FIGS. 22, 23 and 24A that two baffles 25, 25 are disposed one above the other at the bottom of the firearm suppressor 1, for dividing the interior of the cover or housing 2 into respective primary, secondary and tertiary decompression chambers 26, 27, 28. The gases escaping from the live-hinge valves 18 pass into the primary decompression chamber 26, through the openings 23, through slits 29 in the baffle 24, into the secondary decompression chamber 27, through slits 29 in the baffle 25 and into the tertiary decompression chamber 28. It is also noted that acoustic steel wool 30 fills the secondary and tertiary decompression chambers 27 and 28, as is seen in FIG. 25. Finally, the inner surface of the rear end cap 4 has non-reflective facets 31 shown in FIGS. 24A and 24B and/or an anechoic coating disposed thereon.

The gases continue to pass through the slits 29 between the three chambers, through the steel wool 30 and over the facets 31 and/or the anechoic coating, while the speed of the gases and therefore the sound produced thereby continue to dissipate. The gases finally leave the lumen 2' or interior of the cover or housing 2 through the vents 65 shown in FIGS. 1-4.

Figure 36:
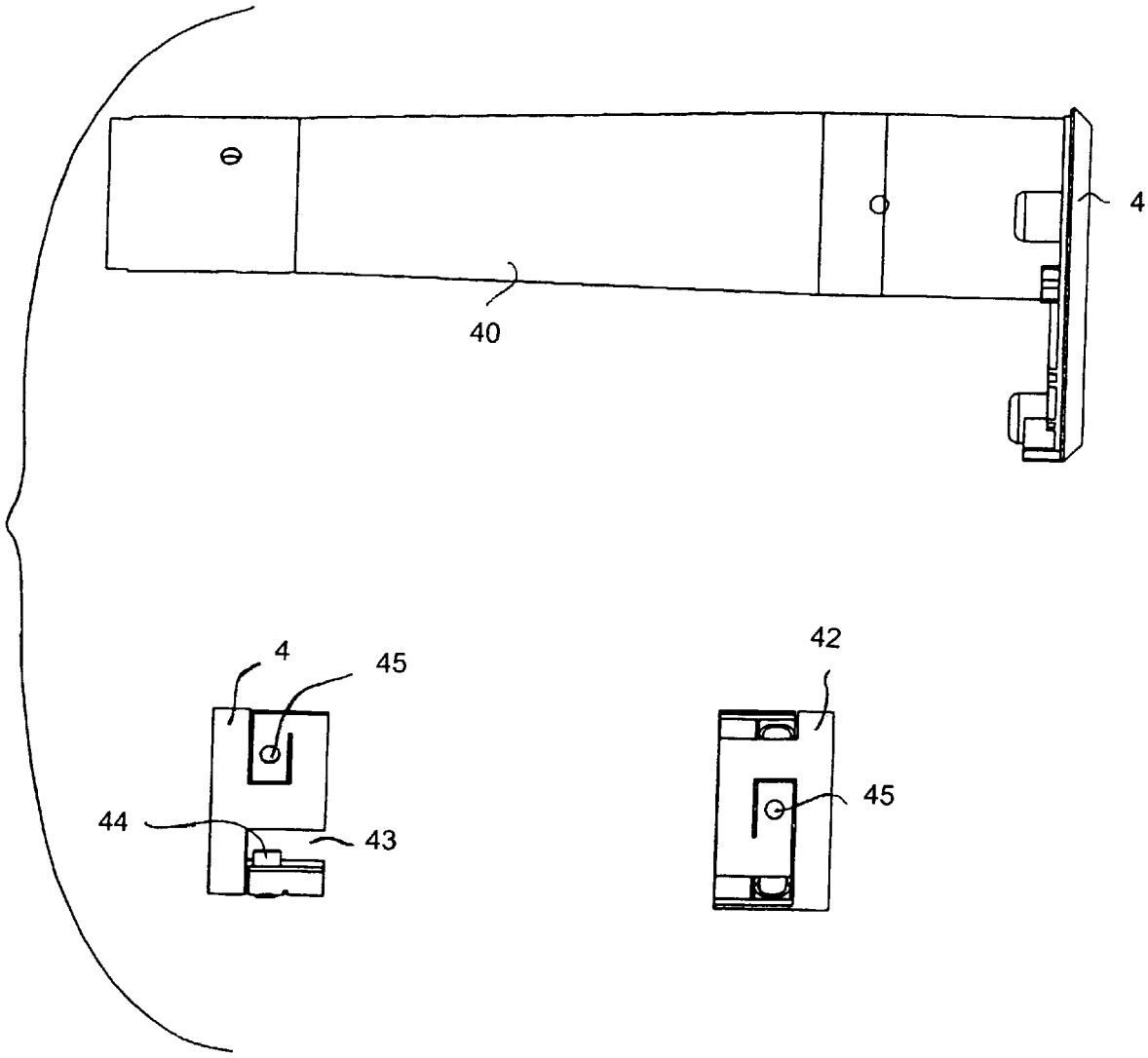
FIGS. 36 and 37 are respective exploded and assembled side-elevational views of the support tube and torsion spring retainers.
Figure 37:
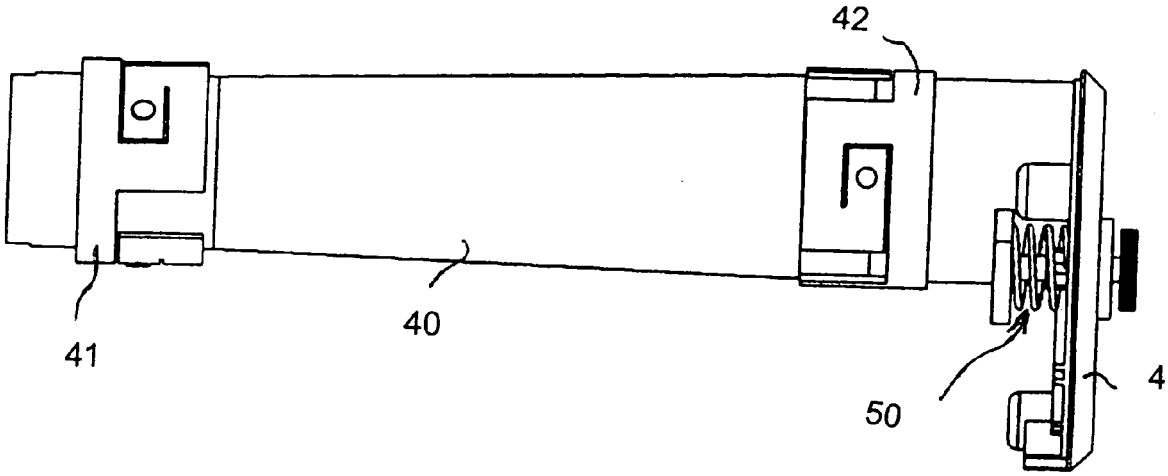

FIGS. 26-31 show the main support tube 40, from which it may be seen that torsion spring retainer units 41, 42 are disposed on the main support tube 40. The torsion spring retainer units 41, 42 are shown in detail in FIGS. 32A-32C and 33-37. More specifically, it is seen that the torsion spring retainer units 41, 42 are annular in shape and have cutouts 43 and holes 45 formed therein. Three locking lugs 44 project inwardly from an inner wall surface of the retainer units 41, 42. A comparison of the exploded view of FIG. 36 and the assembled view of FIG. 37 shows where the retainer units 41, 42 are mounted on the main support tube 40. The retainer units 41, 42 are held to the main support tube 40 by fitting over the support tube and are secured in all directions by the locking lugs 44 which have small end projections 46 extending from the locking lugs 44 and penetrating the matching holes 45 in the end of the retainer units 41, 42.

Figure 28:
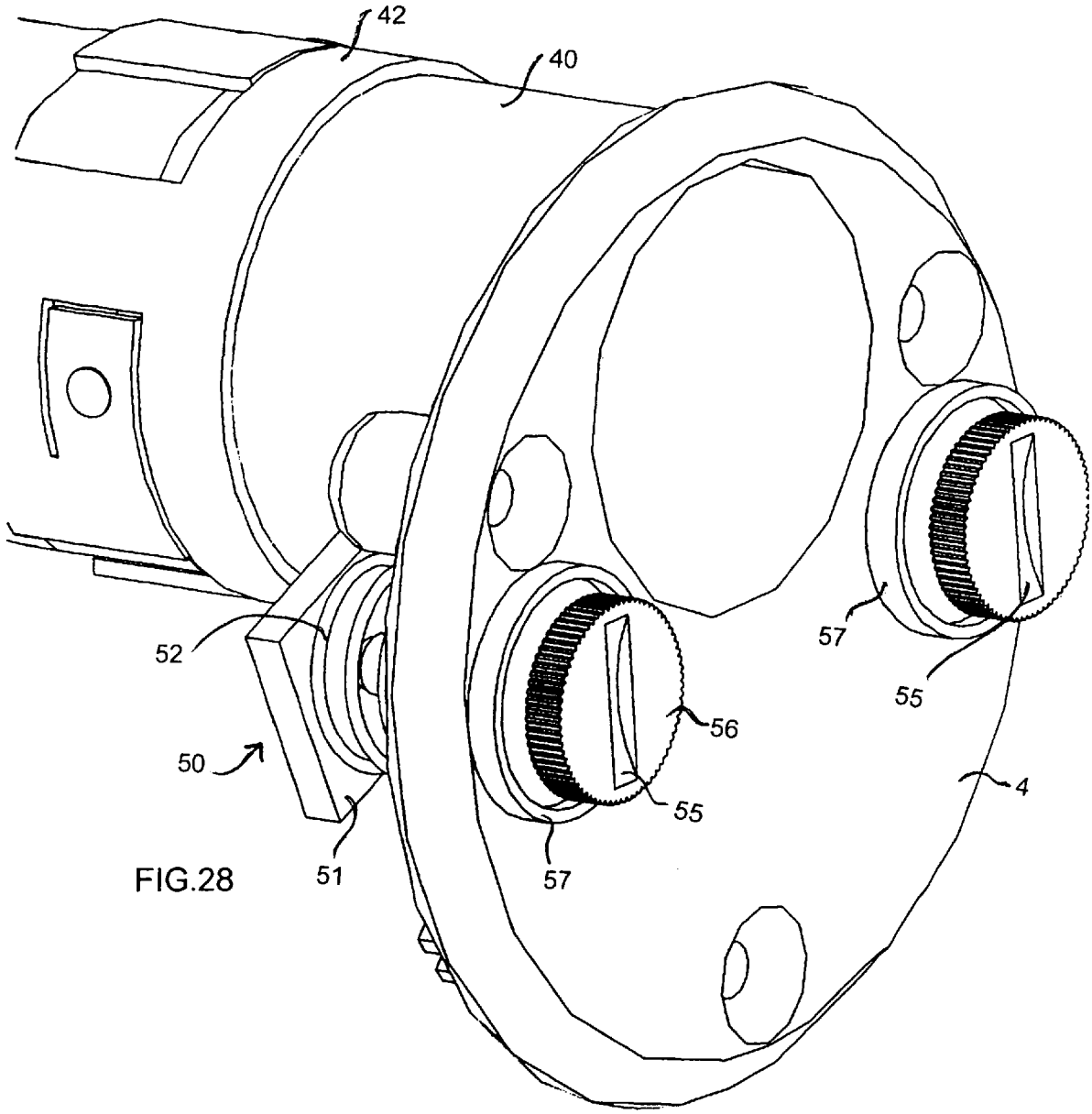
Figure 29:
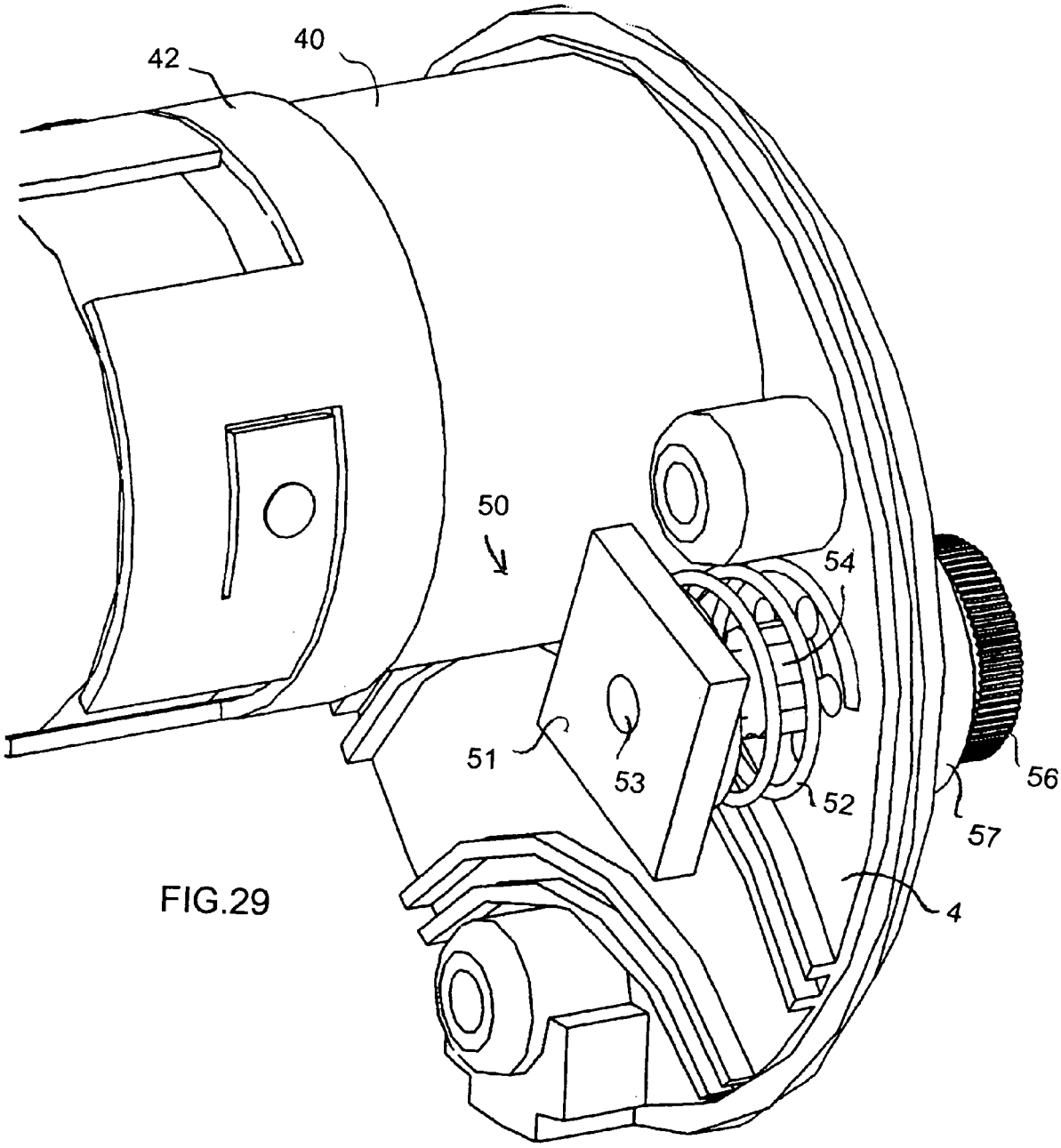

FIGS. 22-23 and 25-27 show the pressure release vents 50, which are illustrated in greater detail in FIGS. 28 and 29. It may be seen that each of the two pressure release vents 50 has a plate 51 mounted on a spring 52 for absorbing pressure of the gases. The plates 51 each have a central hole 53 formed therein for receiving gases from the primary decompression chamber 26 if excess pressures occur. The holes 53 each lead to a tube 54 and finally to a slit 55 in a disk 56 on the end of the tube 54 at the end cap 4, with a ring 57 therebetween, for venting the gases to the atmosphere. The tube 54 can slide within the ring 57 and disk 56 under the oppositely-directed forces exerted by the gases and the spring 52.

Figure 30:
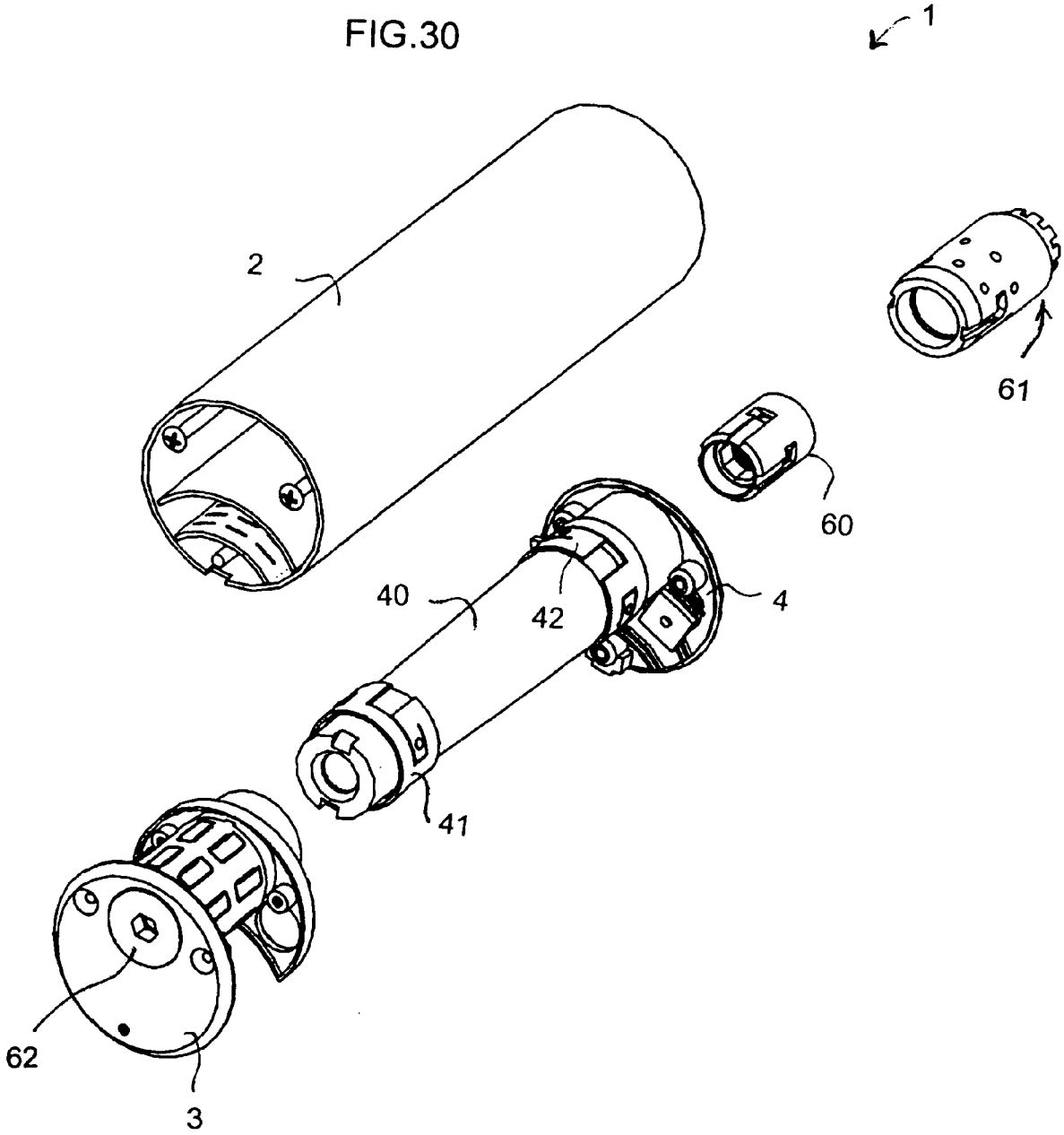
FIGS. 30 and 31 are respective exploded perspective views of subassemblies and disassembled parts of the firearm suppressor.
Figure 31:
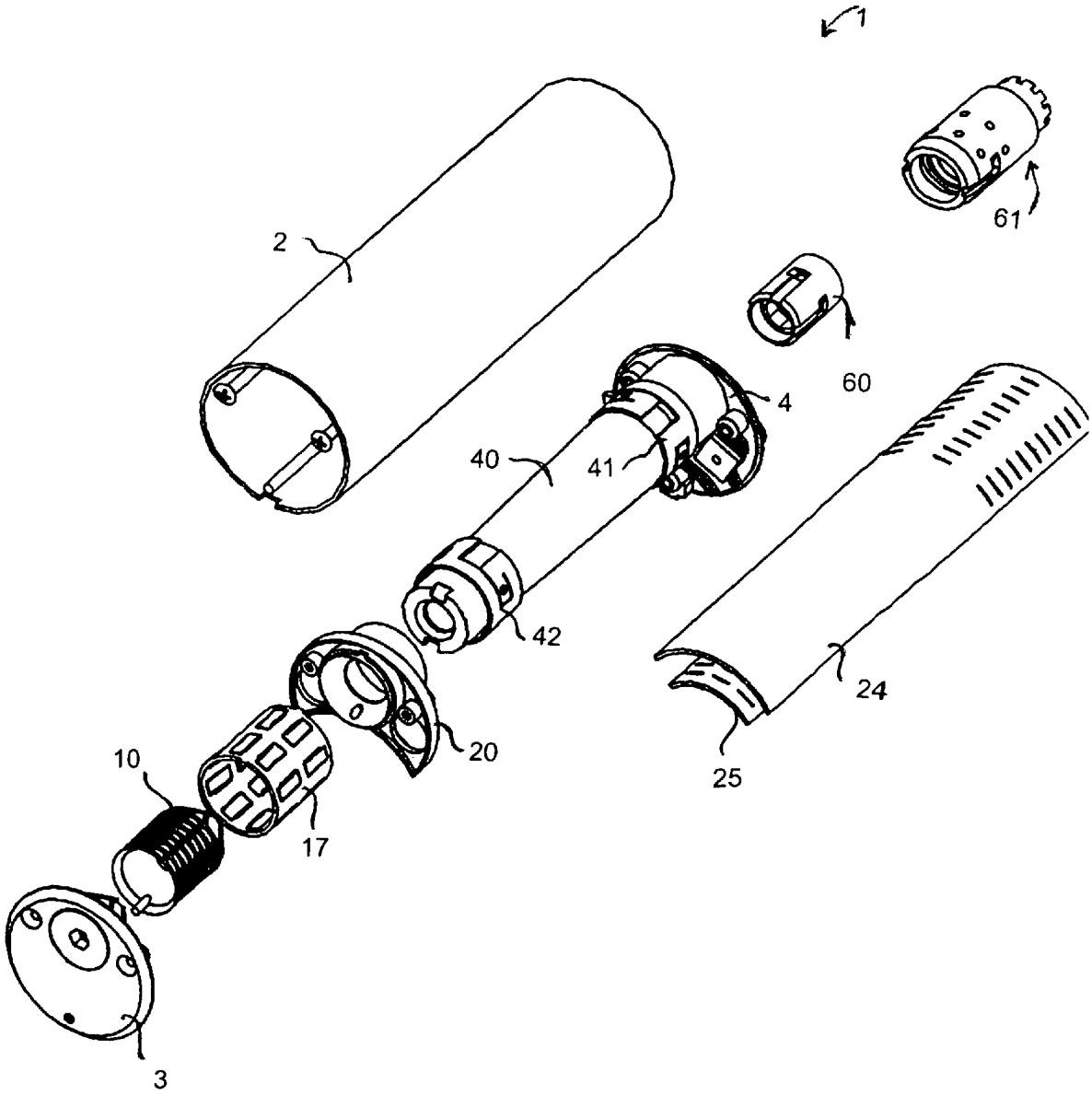
Figure 32A:
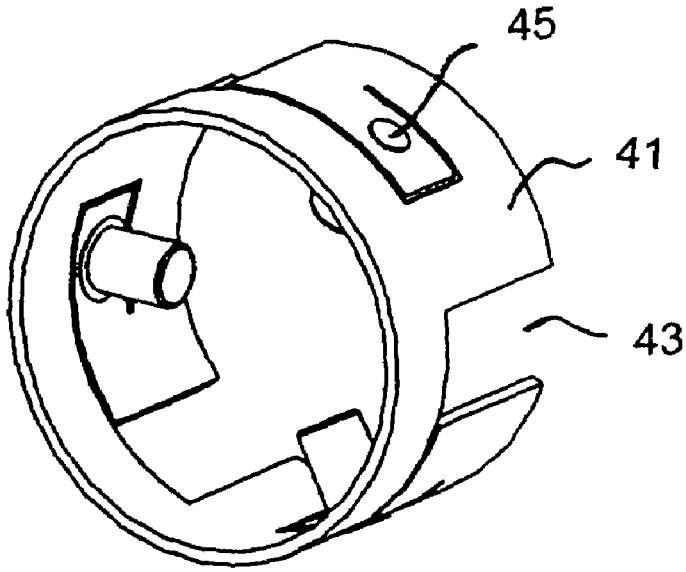
FIGS. 32A-32C are respective perspective, front-elevational and side-elevational views of the torsion retainer spring unit with locking lugs.
Figure 32B:
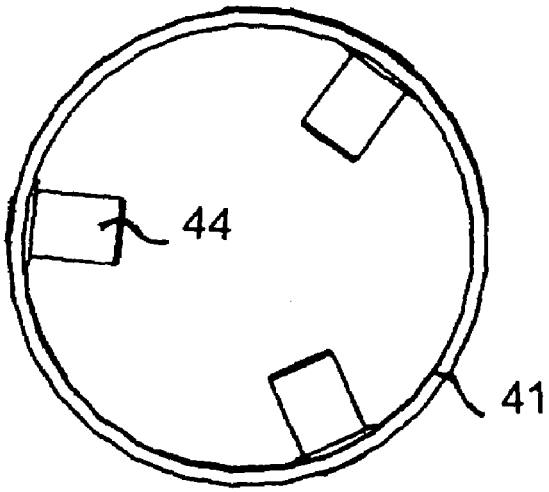
Figure 32C:
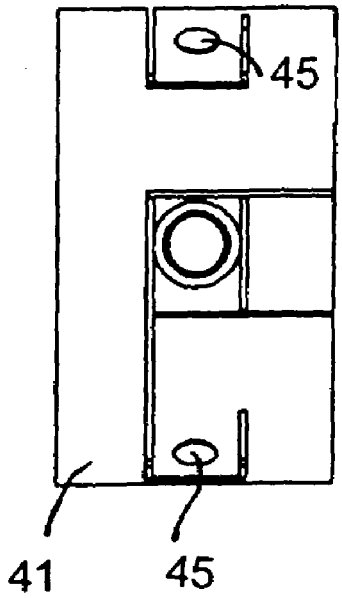
Figure 33:
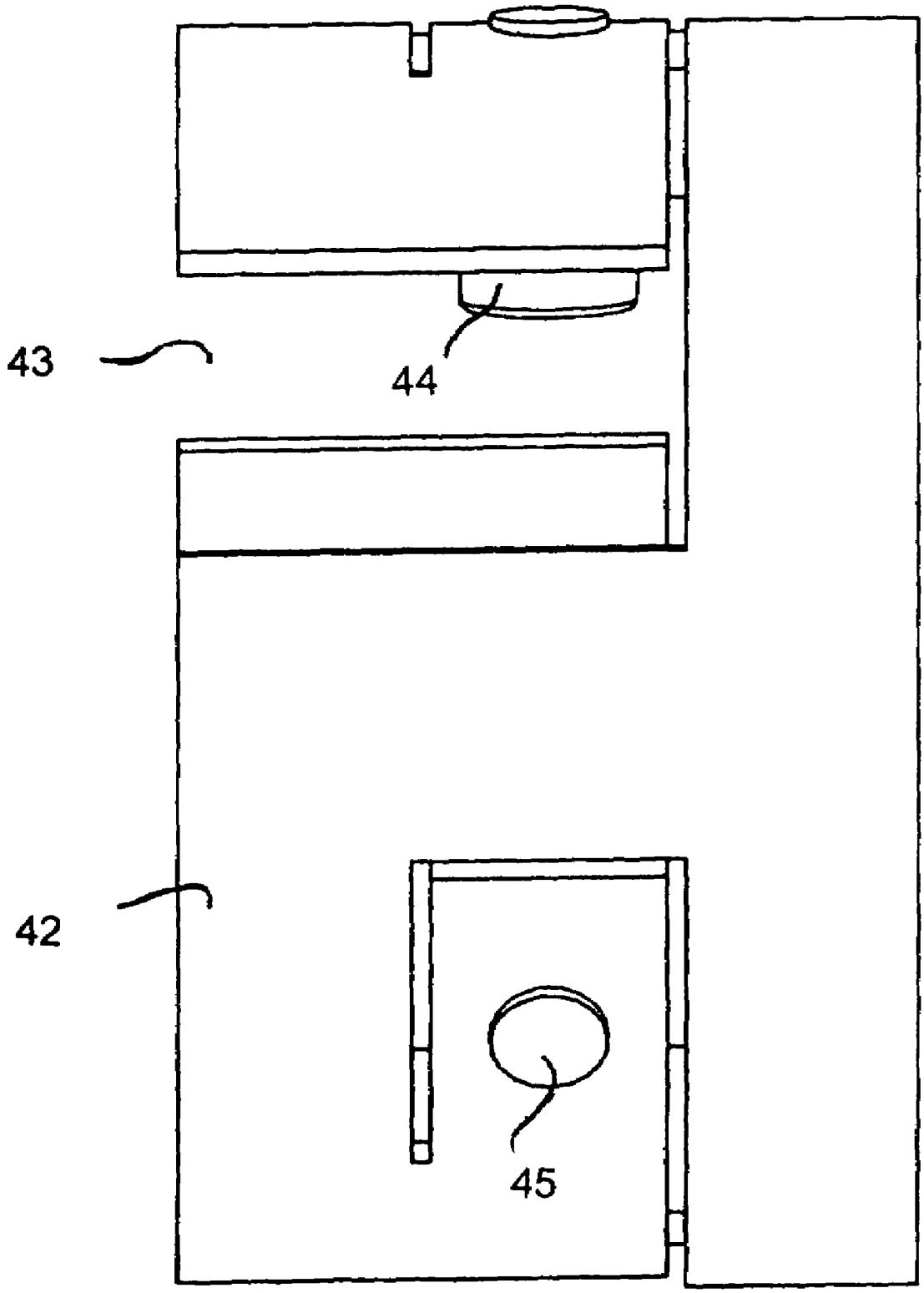
FIGS. 33-35 are respective side-elevational, front-elevational and perspective views of the torsion retainer spring unit with locking lugs.
Figure 34:
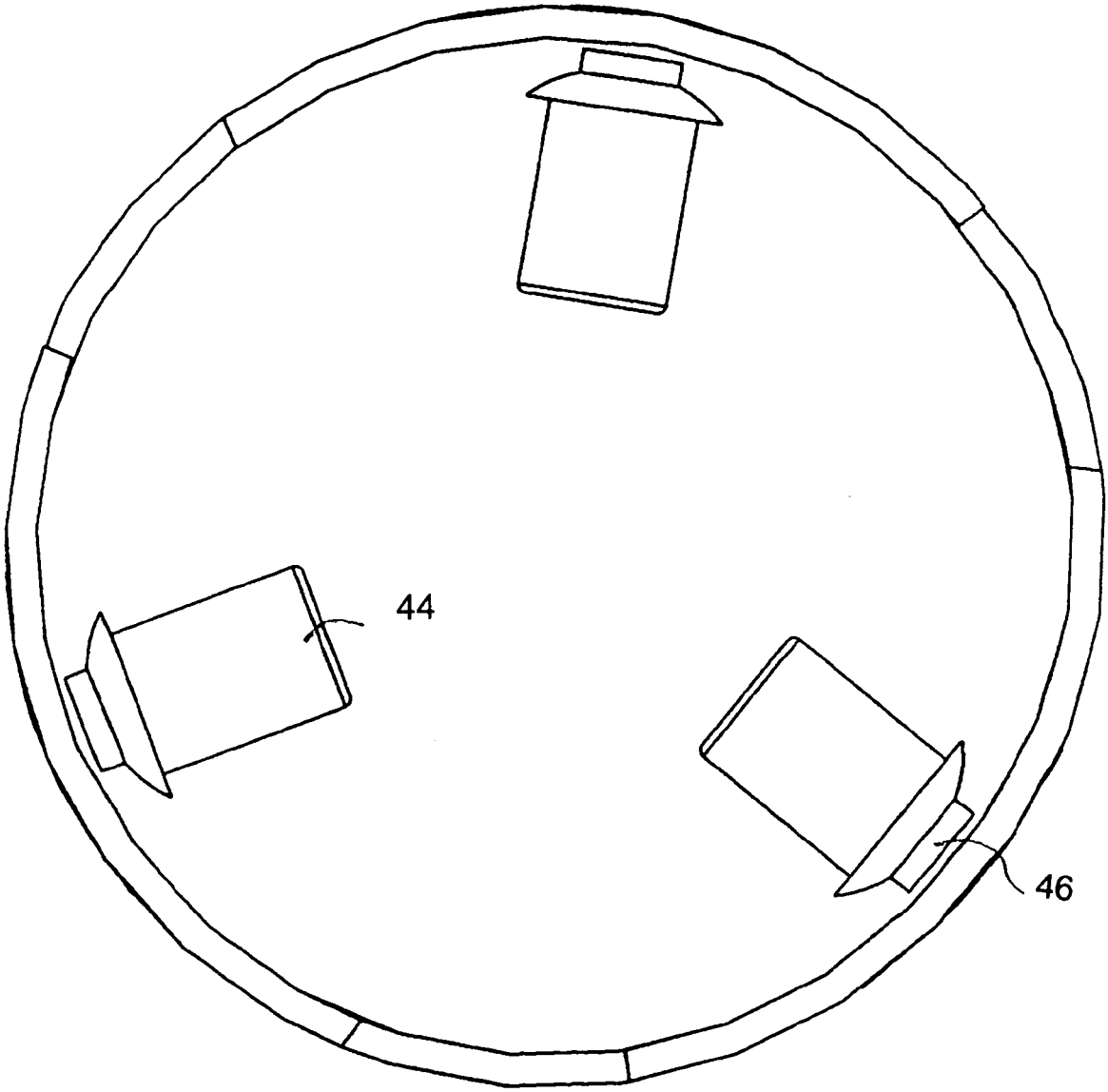
Figure 35:
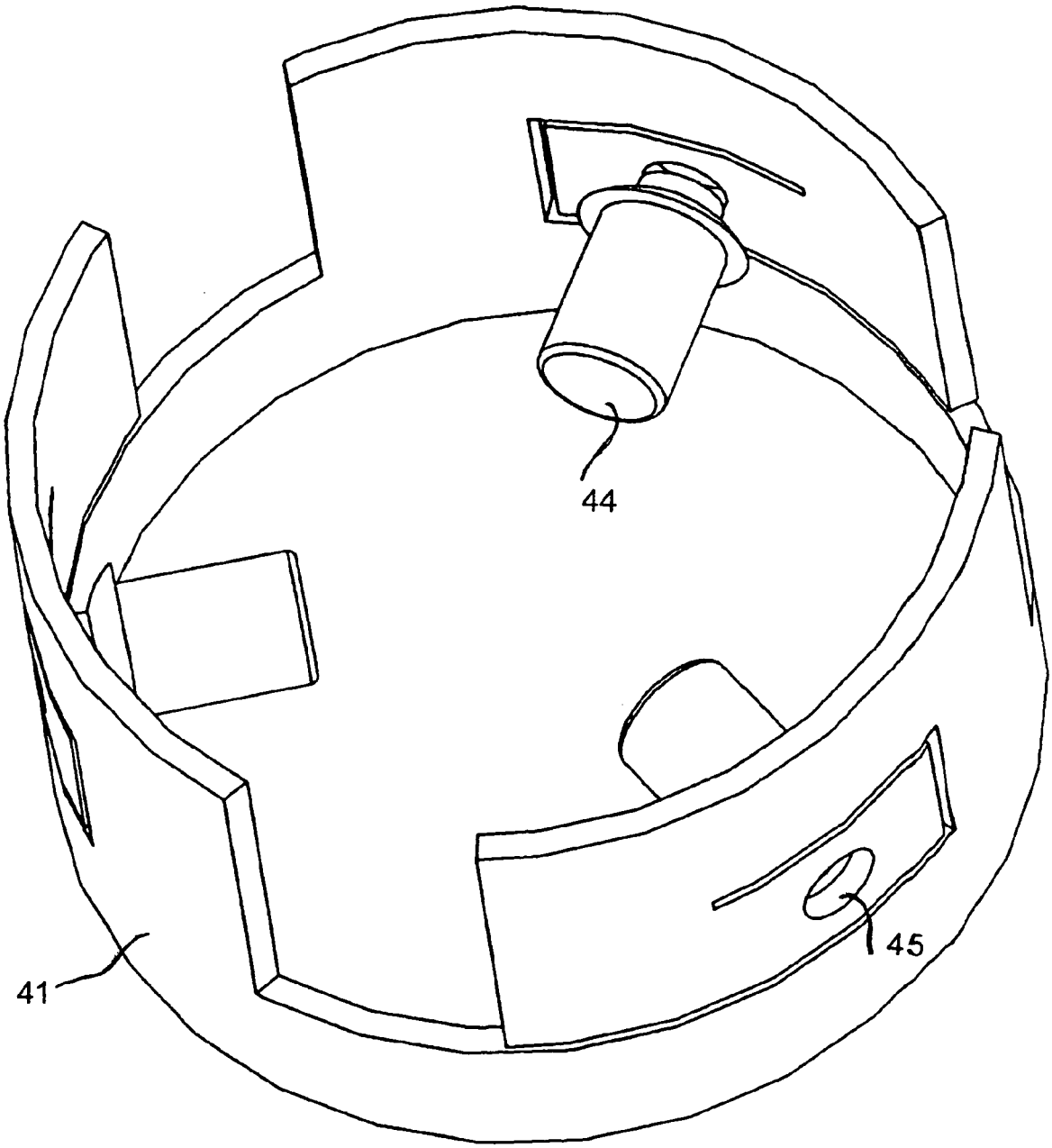
Figure 38:
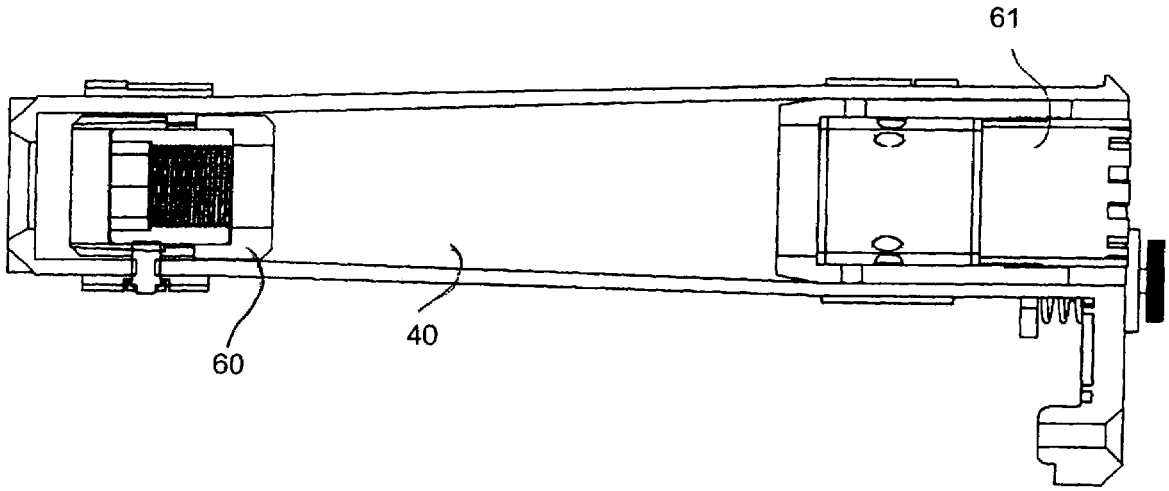
FIGS. 38-40 are respective longitudinal-sectional, top-plan and exploded longitudinal-sectional views of the main support tube, end cap, retainer springs, locking lugs and suppressor mounts, in which the barrel in the main support tube is not shown.

Partially-exploded and fully-exploded views of the suppressor 1 can be respectively seen in FIGS. 30 and 31. These figures show front and rear suppressor or barrel mounts 60, 61 respectively matching the retainer units 41, 42. Whereas FIGS. 38 and 39 show the suppressor mounts 60, 61 in the installed condition with the firearm barrel 15 omitted for clarity, FIG. 40 shows them dismounted from the retainer units 41, 42.

Figure 41:
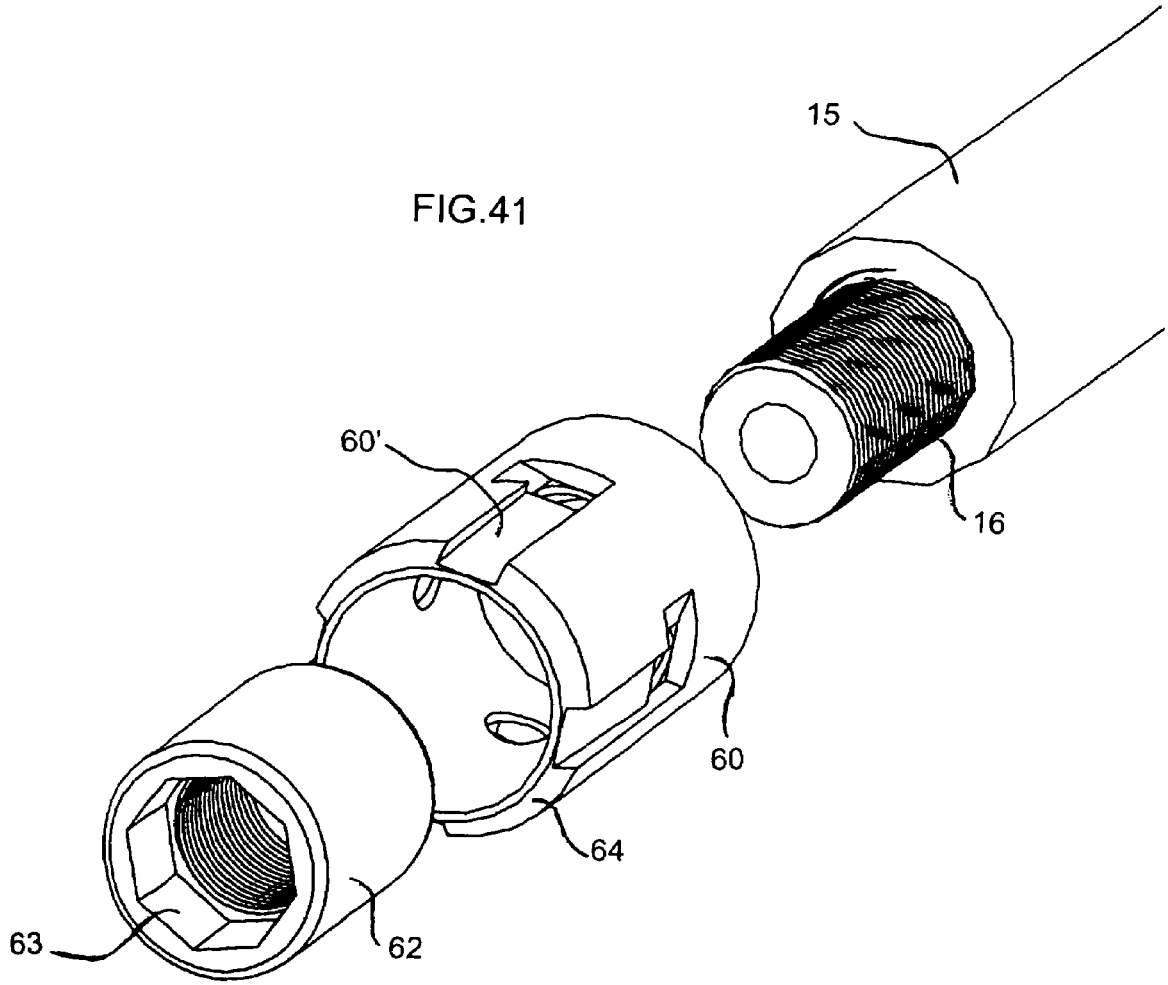
FIGS. 41-43 are respective exploded perspective, side-elevational and perspective views of the suppressor mounts.
Figure 42:
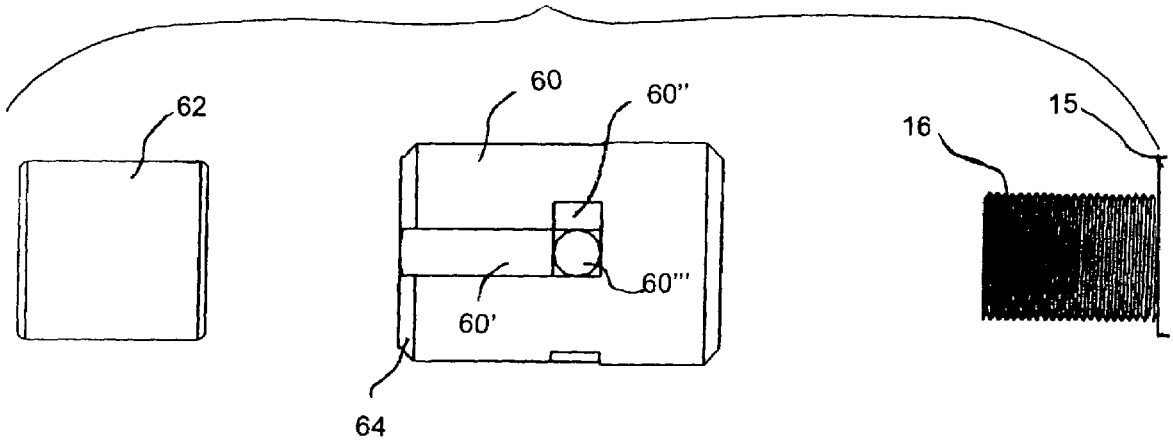
Figure 43:
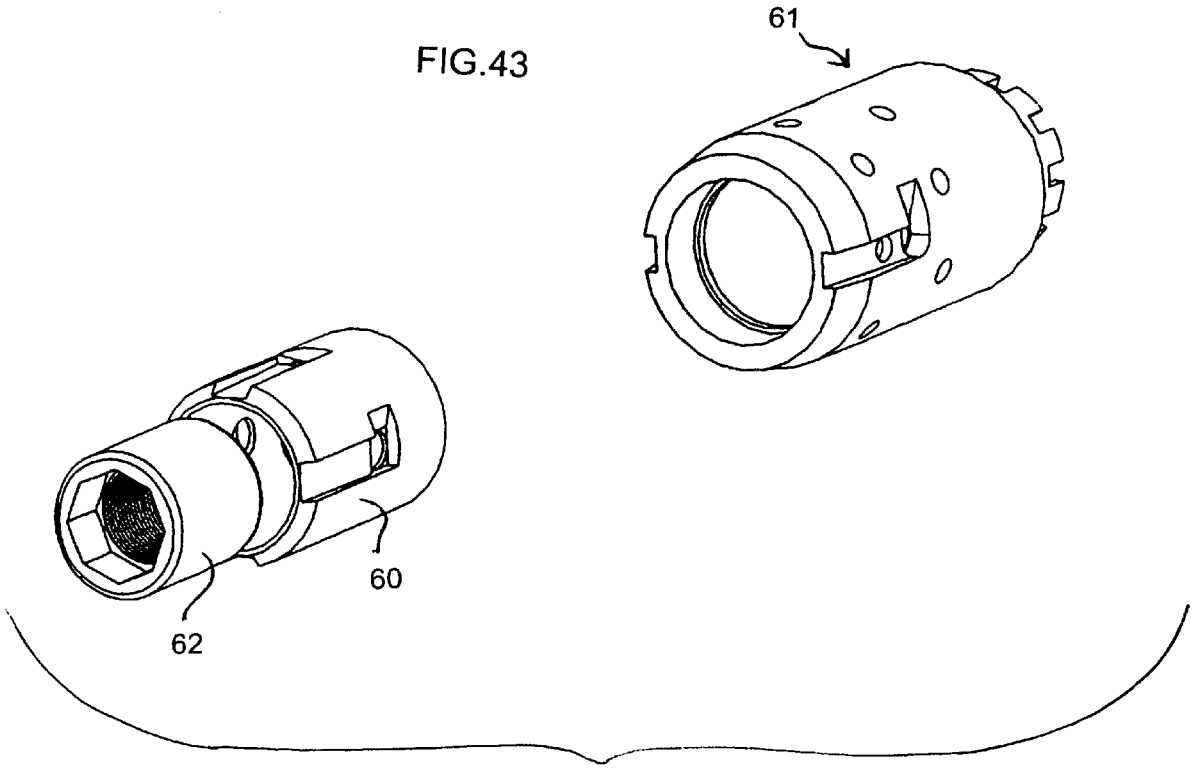
Figure 44:
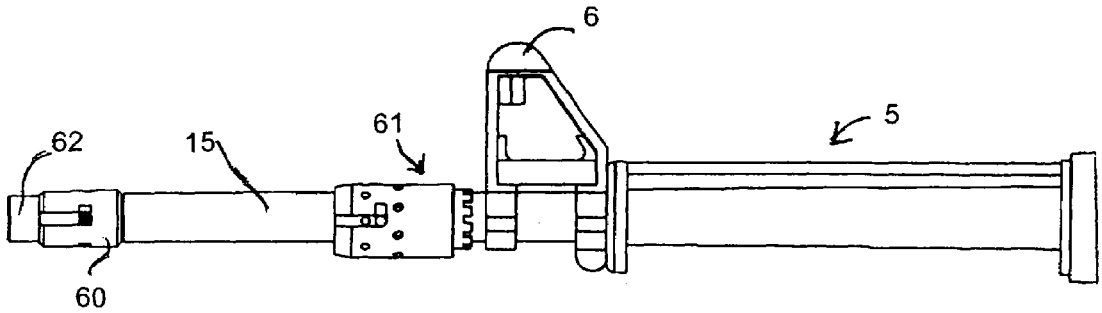
FIGS. 44-46 are respective side-elevational mounted, side-elevational dismounted and perspective mounted views of the mounts and firearm.
Figure 45:
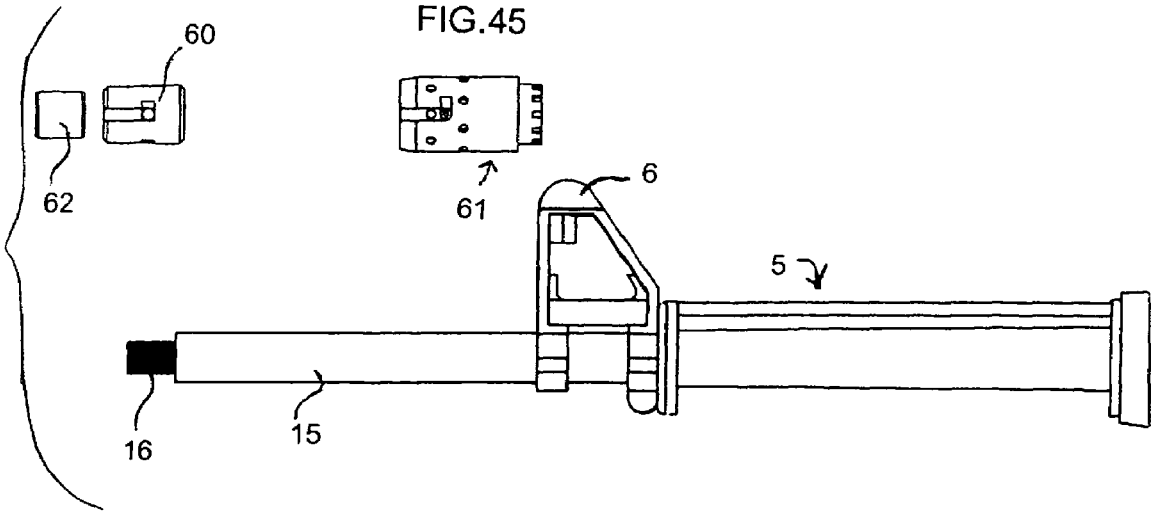
Figure 46:
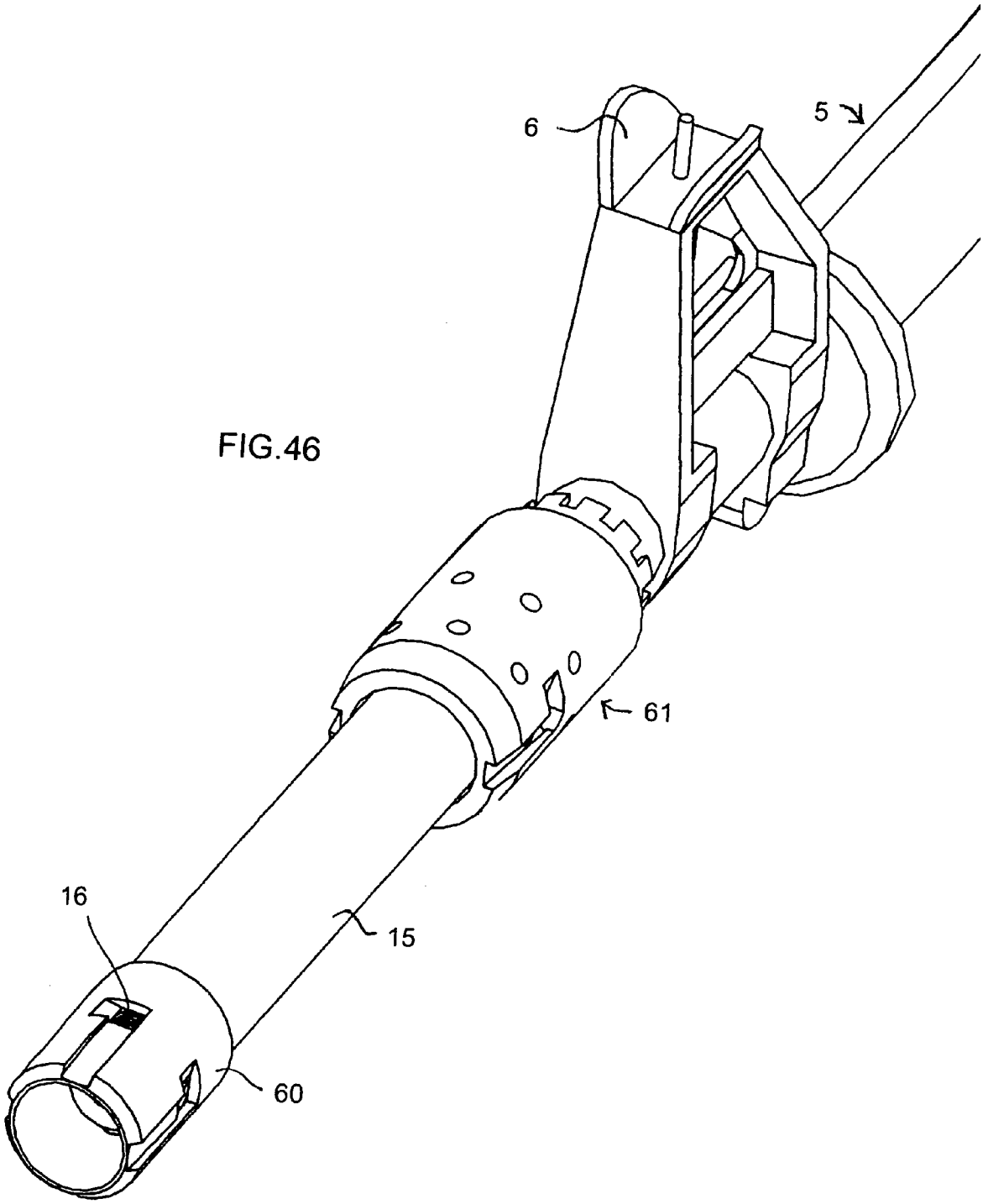
Figure 47:
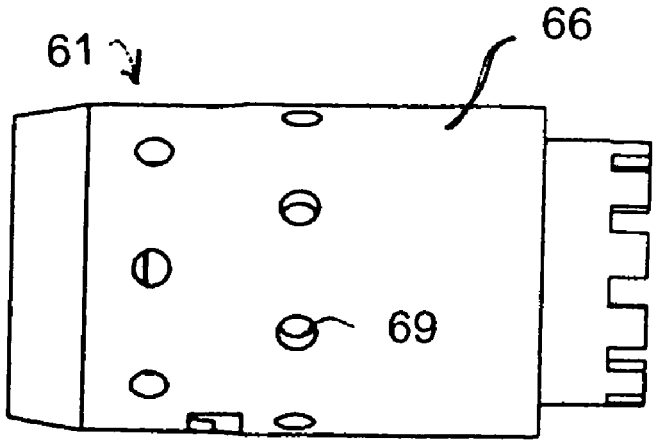
FIGS. 47 and 48 are respective assembled and exploded side-elevational views of the mount, split rings and compression driver.
Figure 48:
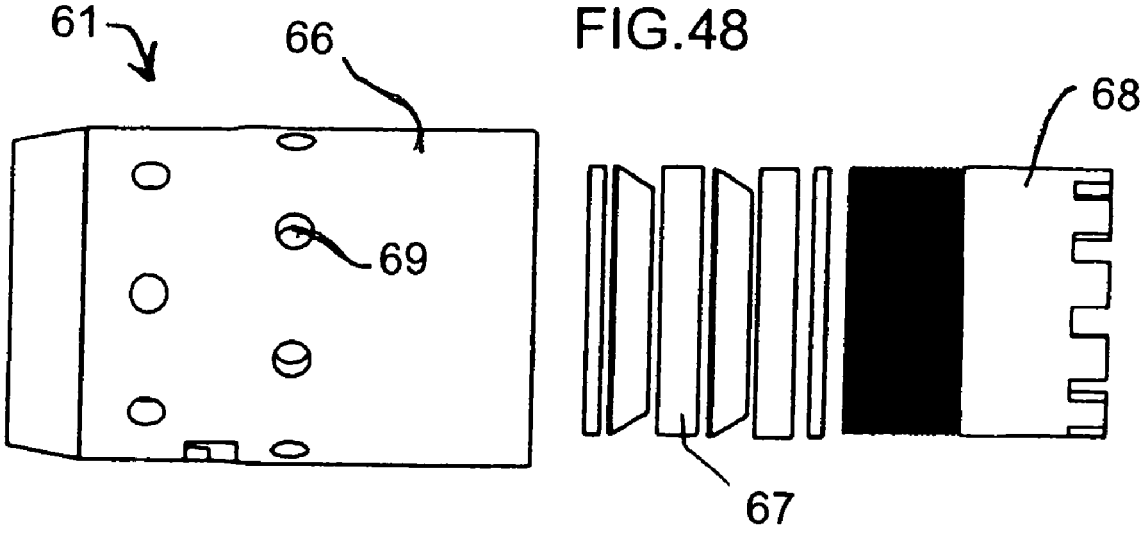

As is seen in FIGS. 41 and 42, a barrel 15 of the firearm 5 has a threaded barrel button 16, onto which a nut 62 is to be driven by a socket wrench inserted at a socket 63. The front suppressor or barrel mount 60 has a forward taper 64 for easy passage of the suppressor. The front suppressor mount 60 contains two or more tapered entrance or in-ramps 60' for the locking lugs 44, which will be explained in more detail below. The rear suppressor or barrel mount 61, which is shown dismounted in FIGS. 43 and 45, remains on the barrel 15 and is securely locked in place as seen in FIGS. 44 and 46.

The rear suppressor mount 61 is formed of three pieces, namely a mount body 66, which slides over the barrel 15 and has a non-illustrated under-cut space for thin split rings 67 of a softer more malleable metal or other suitable material, and a threaded compression driver 68 which slides over the barrel 15 first and screws into the mount body 66, retaining and expanding the overlapping split rings 67 to strongly engage the mount 61 to the barrel 15. In order to ensure increased security of attachment, multiple holes 69 are formed in the mount body 66, providing additional gripping by the softer material split rings 67 under high pressure. A process of high-pressure flow-fusing or bonding is presented where ultimate strength is required. FIGS. 49 and 50 are provided to illustrate that as the split rings 67 are driven together by the threaded compression driver or sleeve 68, the smaller rings contract to contact the barrel 15 and the outer rings expand to contact the mount body 66.

Figure 39:
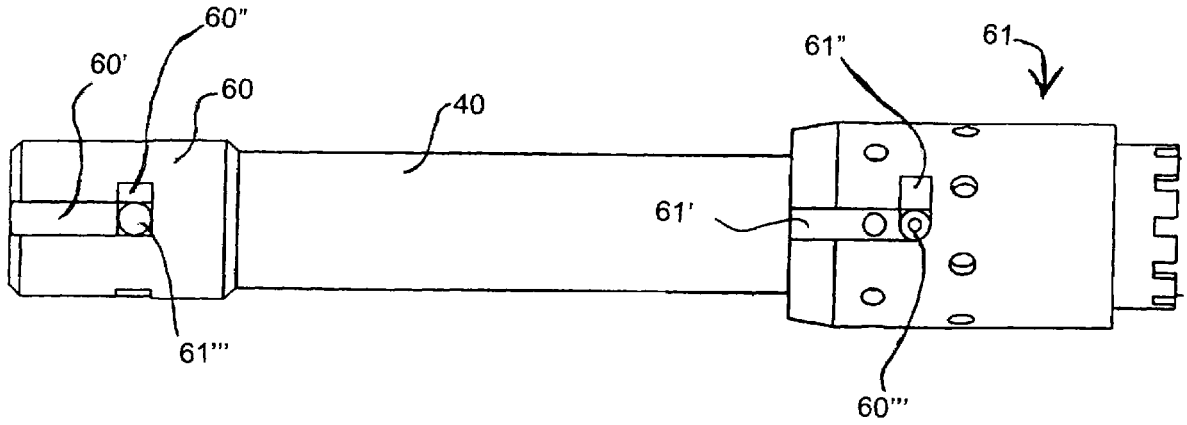
Figure 40:
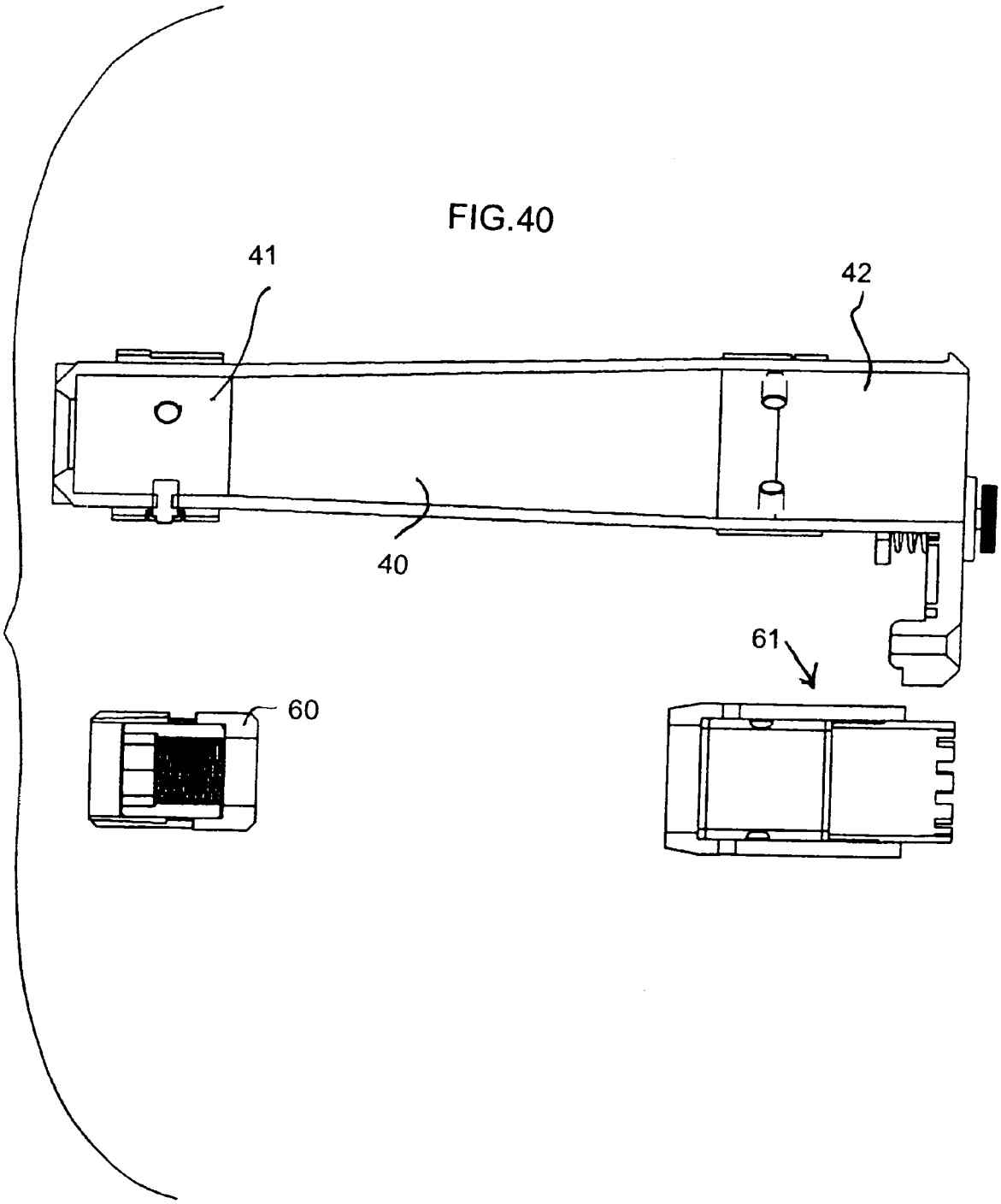

It can be seen from FIG. 39 that the front suppressor mount 60 has the longitudinal in-ramps 60' and lateral out-ramps 60" for the locking lugs 44 of the retainer unit 41. Similarly, the rear suppressor mount 61 has longitudinal in-ramps 61' and lateral out-ramps 61" for locking lugs 44 of the retainer unit 42. The in-ramps allow the suppressor to be directly pushed on. The in-ramps have narrow rear portions and drop into deeper receivers 60''', 61'''. The out-ramps permit quarter-turn unlocking and pulling off detachment of the suppressor.

Figure 51:
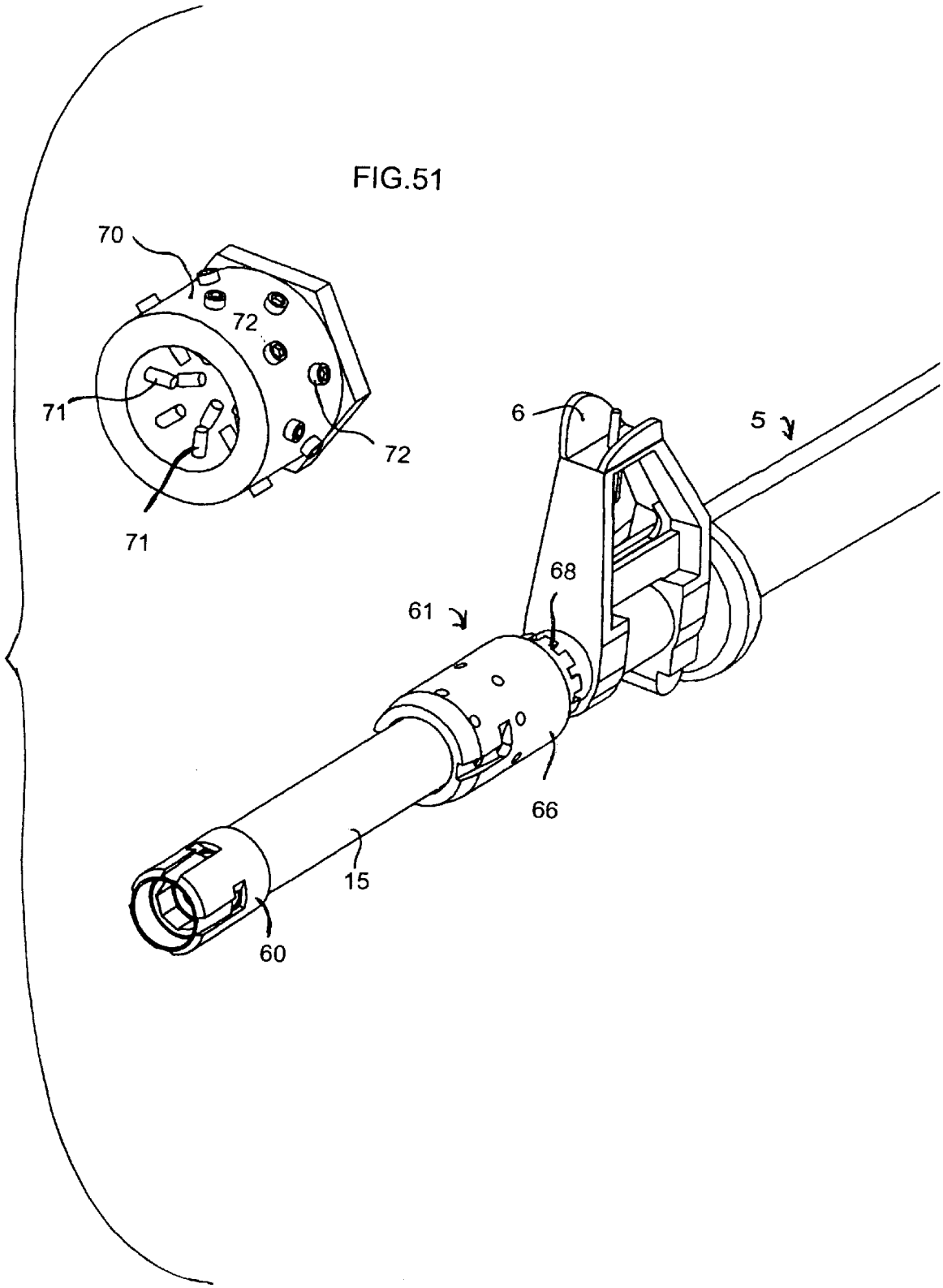
FIGS. 51-54 are respective exploded perspective, assembled side-elevational, assembled perspective and disassembled perspective views of the rear mount and metal flow-fusing fixture mounting system.
Figure 52:
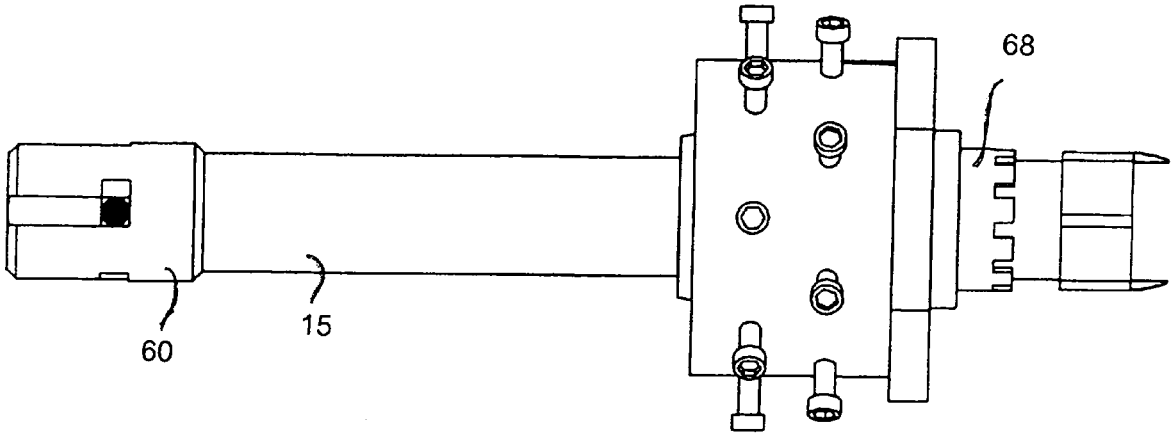
Figure 53:
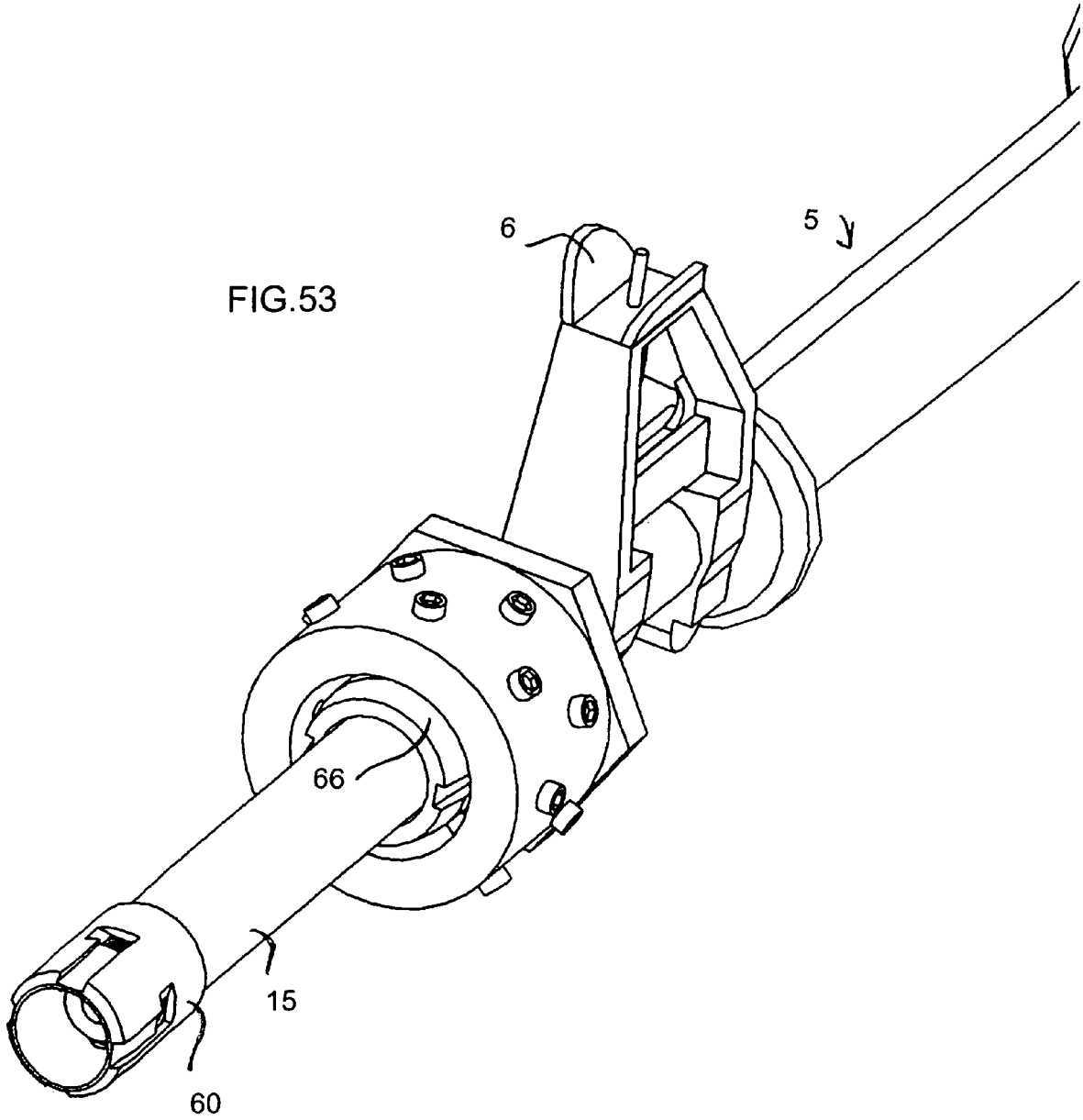

FIGS. 51-53 show a high-pressure, metal flow-fusing fixture 70 of a mounting system configured to fit over the rear suppressor mount 61 for fixing it in place. The high pressure-inducing fixture 70 is constructed of hardened steel or other suitable material and slides or is clamped over or around the rear suppressor mount 61 with great strength. A space which remains between the rear suppressor mount 61 and the barrel 15 is to be filled by a soft metal fusing layer through the use of the fixture 70.

Figure 54:
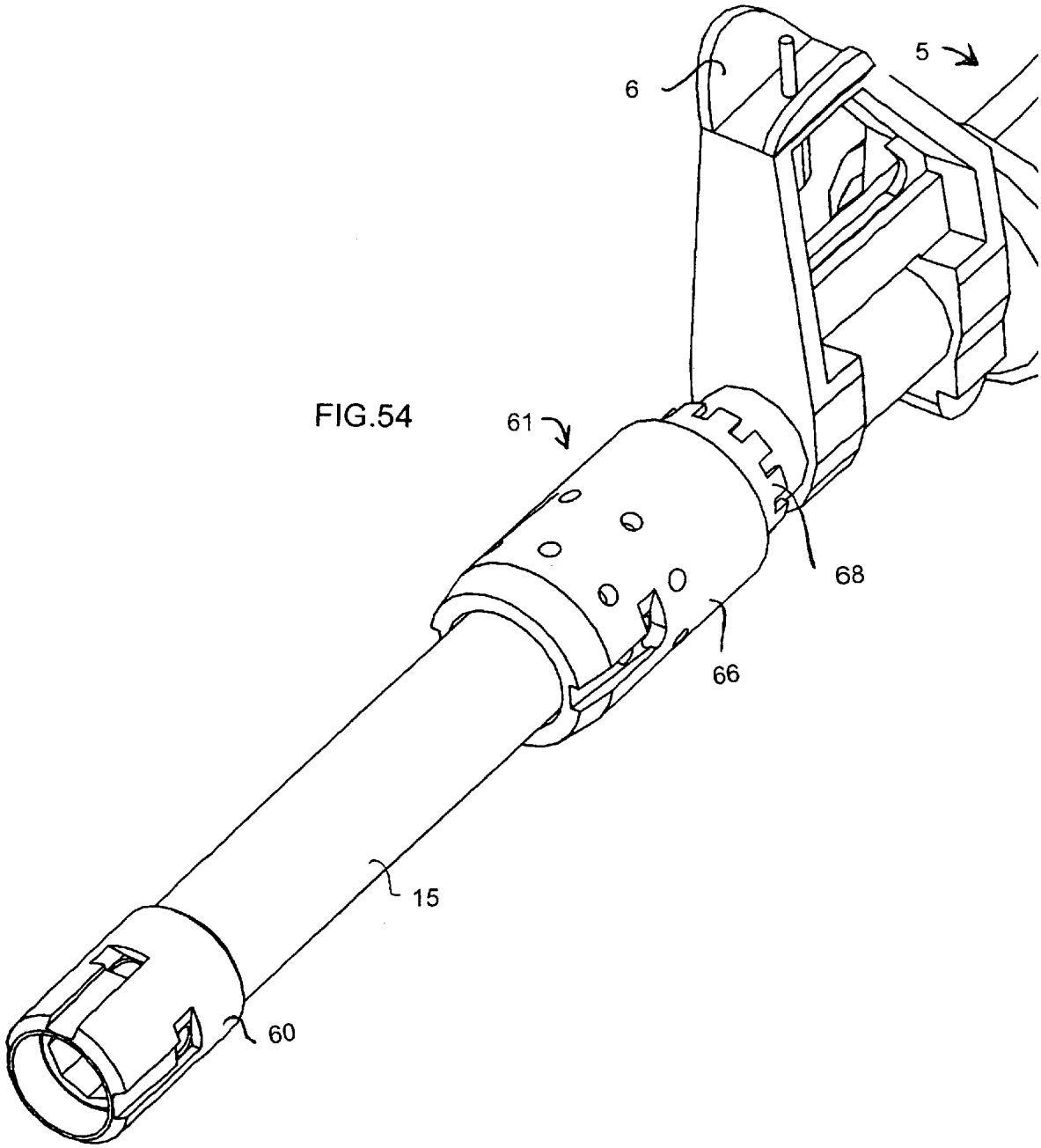

Small, finely threaded, hardened bolts 71 are screwed through the fixture 70 and turned in sequence to create an even and extreme pressure against the relatively soft material of the rear suppressor mount 61, from the condition shown in FIG. 52 into the condition shown in FIG. 53. The compressed metal or material becomes hot and flows into microscopic irregularities of the barrel 15 and the rear suppressor mount 61. Shoulders 72 on the small diameter bolts 71 limit their depth to prevent damage to the barrel. The pressure-flowing fixture 70 is removed after cooling and the rear suppressor mount 61 remains pressure-bonded to the barrel 15, as is seen in FIG. 54.

I claim:

1. A firearm suppressor, comprising:

a housing to be mounted to a firearm, said housing defining a lumen therein for receiving gases from the firearm;

a plurality of stripper cones disposed in said lumen, partially spaced apart from each other to define spacings therebetween and having sharpened upstream edges for engaging and deflecting the gases;

at least one non-lumen occluding, one-way flow element having a live hinge disposed downstream of said stripper cones in gas flow direction for permitting a one-way flow of the gases;

at least two decompression chambers disposed downstream of said at least one one-way flow element for reducing energy in the gases, each two of said decompression chambers having a respective baffle disposed therebetween, said baffle having slits formed therein for conducting a flow of the gases between said decompression chambers; and at least one vent disposed downstream of said at least two decompression chambers for expelling the gases into the atmosphere.

2. The firearm suppressor according to claim 1, wherein said at least one one-way flow element has a plurality of live hinge valves disposed in a collar covering said stripper cones.

3. The firearm suppressor according to claim 2, which further comprises a support tube disposed within said housing, and a middle support member disposed between said support tube and said live hinge collar, said middle support member having an opening formed therein for the gases.

4. The firearm suppressor according to claim 1, wherein said at least two decompression chambers are three decompression chambers having respective baffles disposed therebetween.

5. The firearm suppressor according to claim 4, which further comprises steel wool filling at least one of said decompression chambers.

6. The firearm suppressor according to claim 1, which further comprises a support tube disposed within said housing, two end caps disposed at ends of said housing outside said support tube, tie rods interconnecting said end caps, and at least one vent valve disposed at one of said end caps for relieving excess pressure.

7. The firearm suppressor according to claim 1, which further comprises a support tube disposed within said housing, at least one torsion spring retainer unit disposed on said support tube, and at least one barrel mount disposed on said at least one retainer unit for mounting the suppressor on a barrel of the firearm.

8. The firearm suppressor according to claim 7, wherein said at least one torsion spring retainer unit includes two torsion spring retainer units, and said at least one barrel mount includes a front barrel mount to be screwed to a threaded button on the barrel and a rear barrel mount to be fused to the barrel.

9. The firearm suppressor according to claim 8, wherein said retainer units have inwardly-projecting locking lugs for holding said retainer units to said support tube.

10. The firearm suppressor according to claim 9, wherein said front and rear suppressor mounts have in-ramps, out-ramps and receivers for said locking lugs of said retainer units, permitting the suppressor to be directly pushed on and pulled off by turning.

11. The firearm suppressor according to claim 8, wherein said rear barrel mount has a mount body with pressurizing parts formed therein, split rings to be disposed within said mount body and a compression driver for expanding and contracting respective ones of said split rings between said mount body and the barrel.

12. The firearm suppressor according to claim 11, which further comprises a fusing fixture to be placed over said rear barrel mount, said fusing fixture having pressure bolts threaded therethrough for applying pressure to said rear barrel mount and fusing said mar barrel mount to the barrel, said fusing fixture being removed after fusing.

13. The firearm suppressor according to claim 11, which further comprises two end caps disposed at ends of said housing, said front barrel mount having a nut disposed at one of said end caps.

14. The firearm suppressor according to claim 1, which further comprises at least one vent valve for venting gases at excess pressure from said lumen, said at least one vent valve having a tube for the gases and a spring cooperating with said tube for absorbing pressure of the gases.

15. The firearm suppressor according to claim 1, which further comprises two end caps disposed at ends of said housing, at least one of said end caps having an inner surface with non-reflective facets disposed thereon.

16. The firearm suppressor according to claim 1, which further comprises two end caps disposed at ends of said housing, at least one of said end caps having an inner surface with an anechoic coating disposed thereon.

17. The firearm suppressor according to claim 1, wherein said plurality of stripper cones each include rounded downstream edges providing aerodynamic surfaces or airfoils for pulling additional gas into said stripper cones acting as a gas trap, and laterally curved spacing ridges maintaining said spacing and steering the gases in laterally curving arcs to decrease an angle of impact with a wall of said housing.

* * * * *